US012053016B2

(12) United States Patent
Coscia

(10) Patent No.: US 12,053,016 B2
(45) Date of Patent: Aug. 6, 2024

(54) PORTABLE COMPACT PIPE

(71) Applicant: Robert A Coscia, Riverhead, NY (US)

(72) Inventor: Robert A Coscia, Riverhead, NY (US)

( * ) Notice: Subject to any disclaimer, the term of this patent is extended or adjusted under 35 U.S.C. 154(b) by 440 days.

(21) Appl. No.: 17/077,398

(22) Filed: Oct. 22, 2020

(65) Prior Publication Data

US 2021/0120868 A1 Apr. 29, 2021

Related U.S. Application Data

(60) Provisional application No. 62/925,567, filed on Oct. 24, 2019.

(51) Int. Cl.

| | |
|---|---|
| ***A24F 1/32*** | (2006.01) |
| ***A24F 1/14*** | (2006.01) |
| ***A24F 1/30*** | (2006.01) |

(52) U.S. Cl.

CPC ..... *A24F 1/14* (2013.01); *A24F 1/30* (2013.01); *A24F 1/32* (2013.01)

(58) Field of Classification Search

None

See application file for complete search history.

(56) References Cited

U.S. PATENT DOCUMENTS

| | | | | |
|---|---|---|---|---|
| 3,902,505 A * | 9/1975 | Carleton | ..... | A24F 1/00 131/192 |
| 4,648,410 A * | 3/1987 | Seroussi | ..... | A24F 1/30 131/173 |
| 2006/0086364 A1* | 4/2006 | Liu | ..... | A24F 1/30 131/173 |
| 2016/0249678 A1* | 9/2016 | Katz | ..... | A24F 1/32 131/192 |

OTHER PUBLICATIONS

Nosam84, "I made a bong out of a milk carton style bottle, it hits super smooth", Mar. 15, 2016, Reddit.com, accessed Sep. 13, 2023 https://www.reddit.com/r/StonerEngineering/comments/4ajzj8/i_made_a_bong_out_of_a_milk_carton_style_bottle/ (Year: 2016).*

* cited by examiner

*Primary Examiner* — Michael J Felton

(74) *Attorney, Agent, or Firm* — Collard & Roe, P.C.; William Collard

(57) ABSTRACT

There is disclosed a portable compact pipe comprising at least one base section having at least one hole. There is also at least one water container section having at least one hole. Furthermore, there is at least one shield. The base section is coupled to the water container section, at least at one orientation. With this design, a hole on the base section and a hole on the water container section are configured to be lined up. Thus, when the stem is inserted into the hole on the base section, and the hole on the water container section, the stem locks the water container section to the base section.

11 Claims, 41 Drawing Sheets

422.4
31
31.1
41
41.3
100
31.2
31.3
41.2
14
13

100
14
13
422.5
300.1
422.2
31
31.2
11
13
31.1
11.1
100
14

422.3
100
14
13
31.1
31
31.2

13
14
422.1
76
76.2
100
76.3
76.1
13
14
78

PORTABLE COMPACT PIPE

CROSS REFERENCE TO RELATED APPLICATIONS

This application is a non-provisional application that claims the benefit of U.S. Provisional Application Ser. No. 62/925,567 filed on Oct. 24, 2019 the disclosure of which is hereby incorporated by reference in its entirety.

BACKGROUND OF THE INVENTION

At least one embodiment of the invention relates to a portable compact pipe that is configured to be stored in a compact manner and which can be used in a convenient manner. In at least one embodiment of the invention the water pipe is made substantially from disposable material such as paper. If necessary, in at least one portion such as in the stem or shield, the material can be made from metal or other suitable material to survive burning materials in the pipe.

Pipes have been used in the past for use with smoking or inhaling vapors of different materials such as tobacco or other products. However, in many instances these pipes are configured to be expensive and fragile and non-portable. Therefore, there is a need for an inexpensive compact portable pipe.

SUMMARY OF THE INVENTION

In at least one embodiment of the invention there is a portable compact water pipe comprising at least one base section having at least one hole. There is also at least one water container section having at least one hole. Furthermore, there is at least one stem. The base section is coupled to the water container section, at least at one orientation. With this design, a hole on the base section and a hole on the water container section are configured to be lined up. Thus, when the stem is inserted into the hole on the base section, and the hole on the water container section, the stem locks the water container section to the base section. While many different materials can be used, the structure of the base elements can be made from paper or a modified paper product while the stem can be made from a more substantial fire-proof material such as metal. However, in at least one embodiment the base components or elements such as the water container, the base, or the stem can be made from plastic or from any other suitable material. With at least one embodiment, there is created interlocking shapes forming a smoking device with interchangeable parts. In at least one embodiment, the different parts can fold flat with fold lines.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views:

FIG. 15B is an end perspective view of the embodiment of FIG. 15A with side flaps folded in;

DETAILED DESCRIPTION OF PREFERRED EMBODIMENTS

Figure 1A:
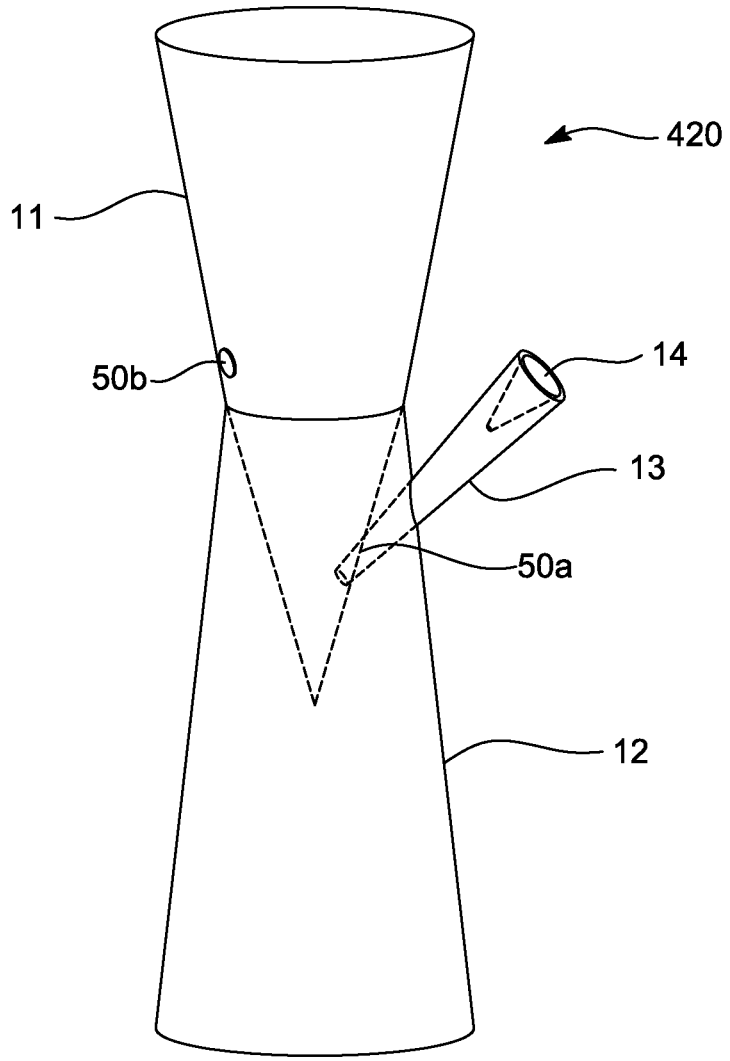
FIG. 1A is a side view of a first embodiment of a portable compact water pipe.

Referring to the drawings, FIG. 1A shows a top substantially conical water container 11. This container 11 includes a first hole 50*a* and a second hole 50*b*. First hole 50*a* is that of a bottom section of water container 11. Second hole 50*b* is an intermediate portion of water container 11. There is also a base 12 which is substantially frustoconical in shape.

Figure 1B:
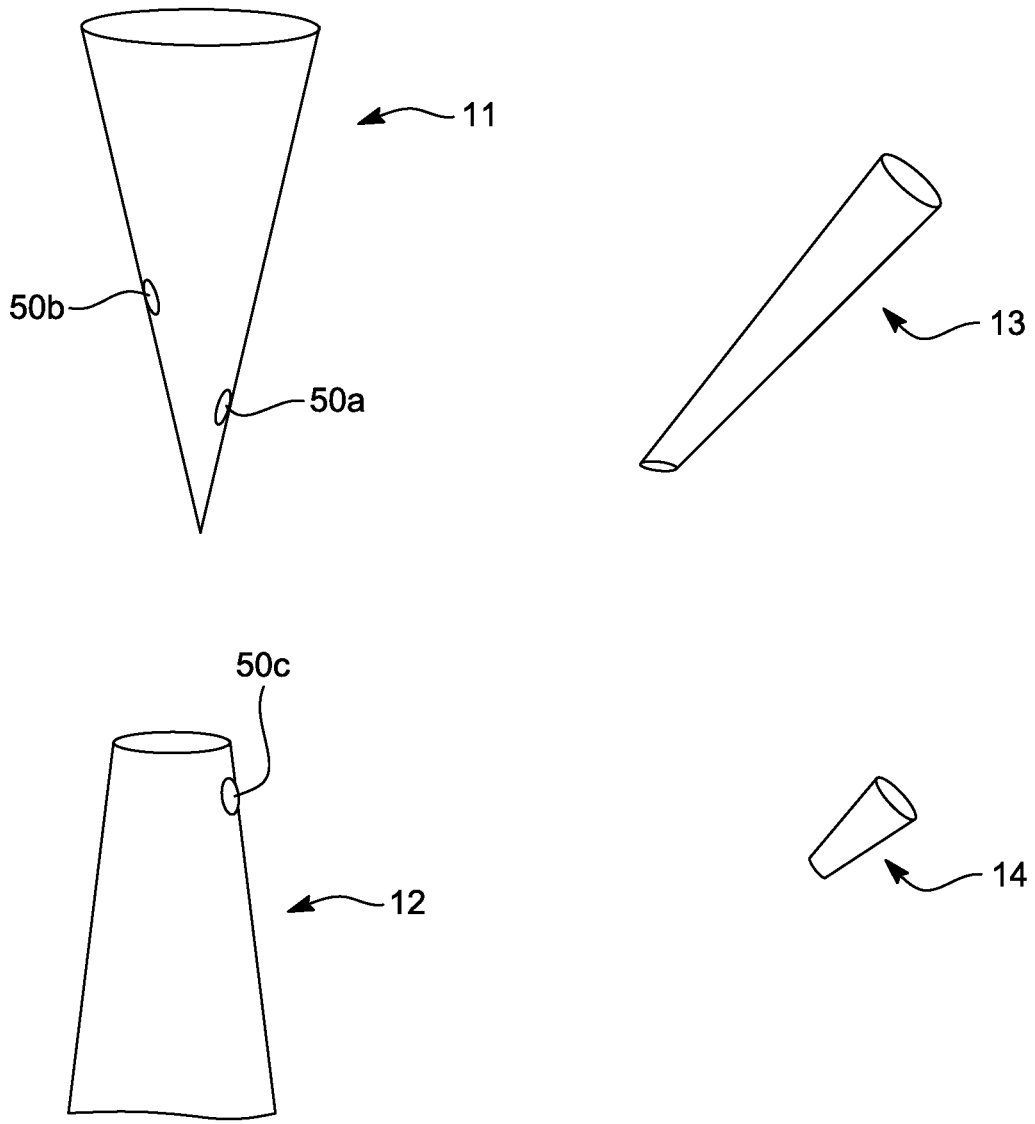
FIG. 1B is a side exploded view of the embodiment shown in FIG. 1A.

FIG. 1B shows an exploded side view of water container pipe 420 which shows first hole 50*a*, and second hole 50*b*. In addition, there is also shown a frustoconical shaped stem 13 as well as a frustoconical shaped base 12 having third hole 50*c*. There is also a shield 14 which is sized to fit substantially inside of stem 13. Shield 14 is also substantially frustoconical in shape. Shield 14 can be made of any material but in at least one embodiment is made from a metal material such as aluminum or another metallic material. Frustoconical shaped is a substantially conical shape with both a first open end and a second open end.

Figure 1C:
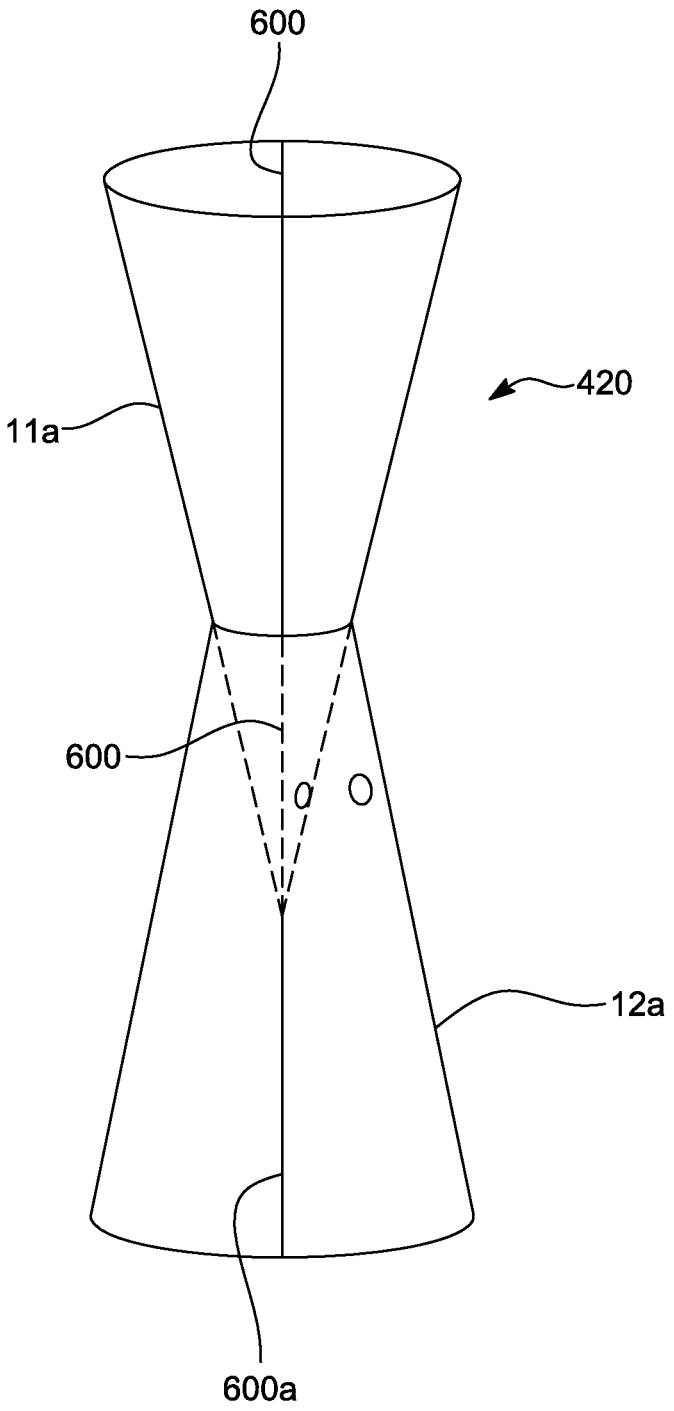
FIG. 1C is a side view of a modified version of the embodiment of FIG. 1A wherein there are folds or seams in the portable compact water pipe.

FIG. 1C is a side view of another embodiment 420 which shows a water container 11*a* as well as a base 12*a*. Water container 11*a* has a crease 600 formed in it allowing water container 11*a* to be folded at least along crease 600. Base 12*a* also has a crease 600*a* allowing base 12*a* to be folded as well.

Figure 2A:
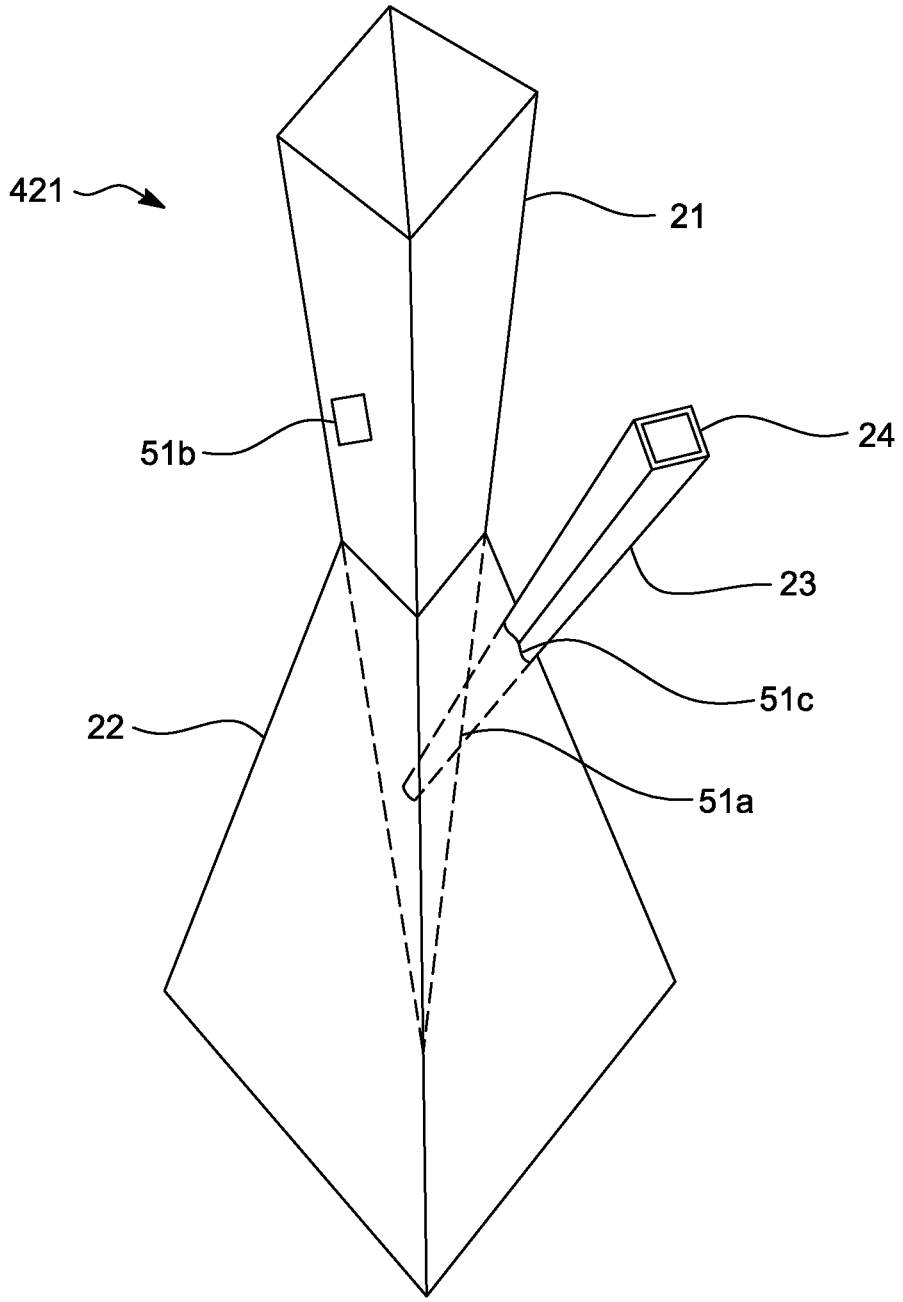
FIG. 2A is a perspective view of another embodiment of a portable compact water pipe.
Figure 2B:
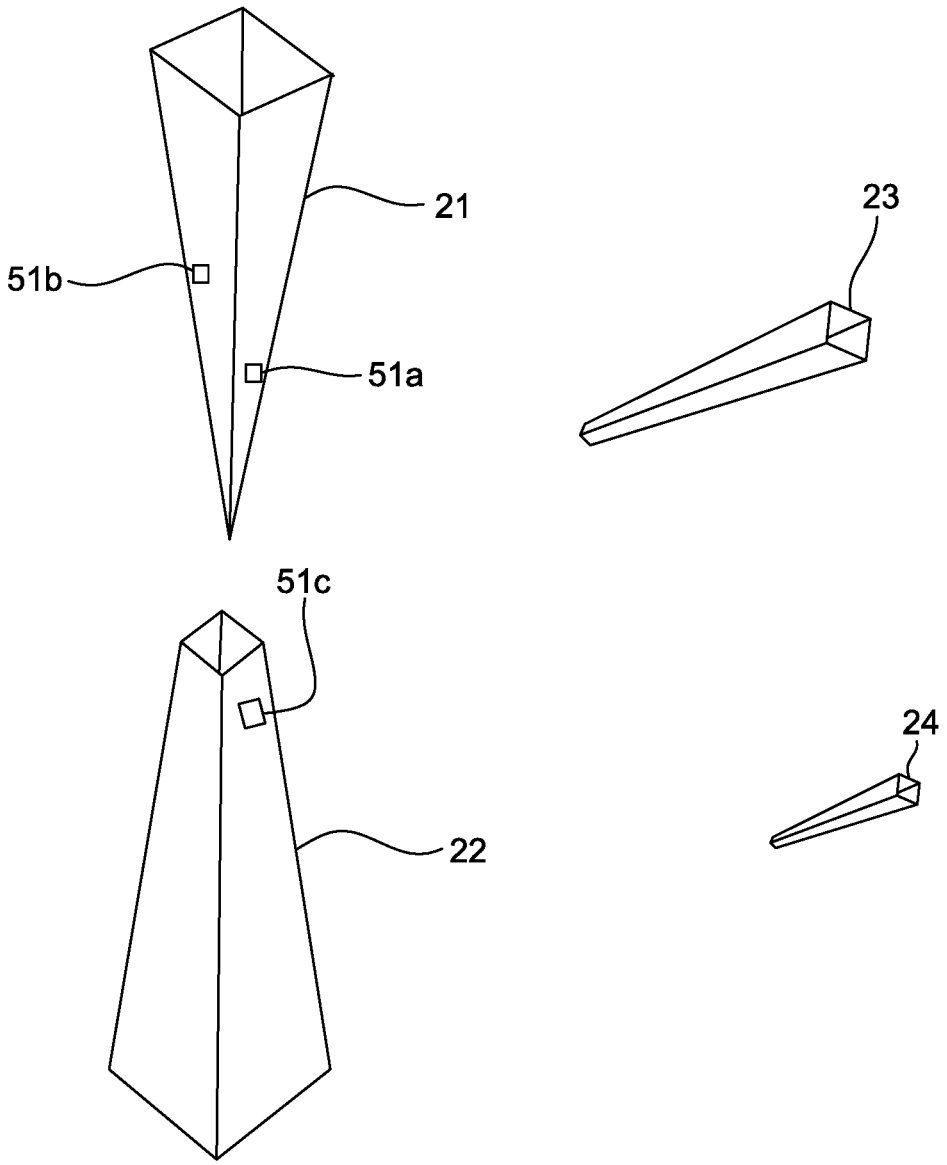
FIG. 2B is an exploded view of the embodiment of FIG. 2A.

FIG. 2A shows a perspective view of another embodiment. With this embodiment 421 there is a substantially pyramidal shape water container 21. There is also substantially pyramidal shaped base 22. Both water container 21 and base 22 each have a corresponding hole with water container 21 having a first hole 51*a* and a second more mid-level hole 51*b* wherein base 22 has a hole 51*c*. Stem 23 fits through hole 51*a* as well as into hole 51*c* thereby locking water container 21 to base 22. Stem 23 is configured to allow for the positioning of shield 24 inside. Both stem 23 and shield 24 have opposite ends that are open thereby forming a substantially pyramidal shaped element (See also FIG. 2B). This shape allows for air to pass along the longitudinal axis of both stem 23 and shield 24. Shield 24 can be made from a substantially nonperishable material such as metal.

Figure 2C:
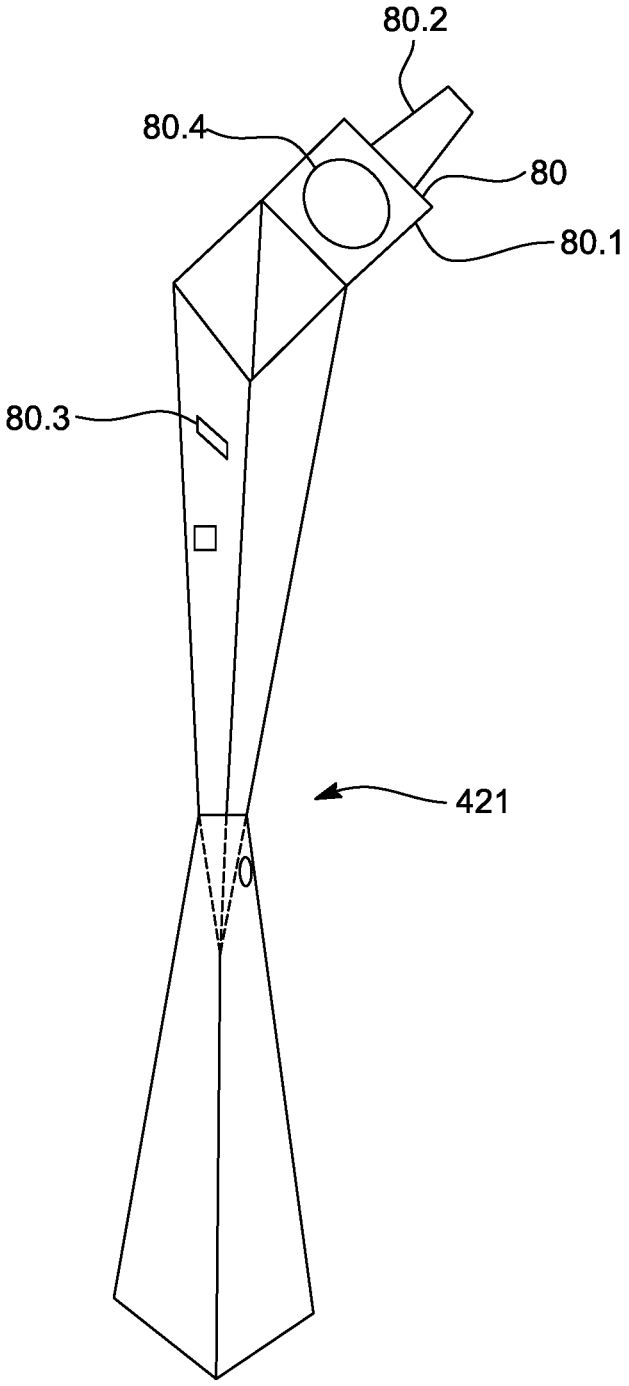
FIG. 2C is another embodiment of a portable compact water pipe.

FIG. 2C shows a substantially perspective view of the device assembled. With this design, there is also a flap 80 comprising a first section 80.1 and a second section 80.2. First section 80.1 includes a hole 80.4 disposed therein. Flap 80.2 is configured to extend down along the longitudinal axis of water container 21 and into slot 80.3 when flap 80.1 is extended over a top section of water container 21.

Figure 2D:
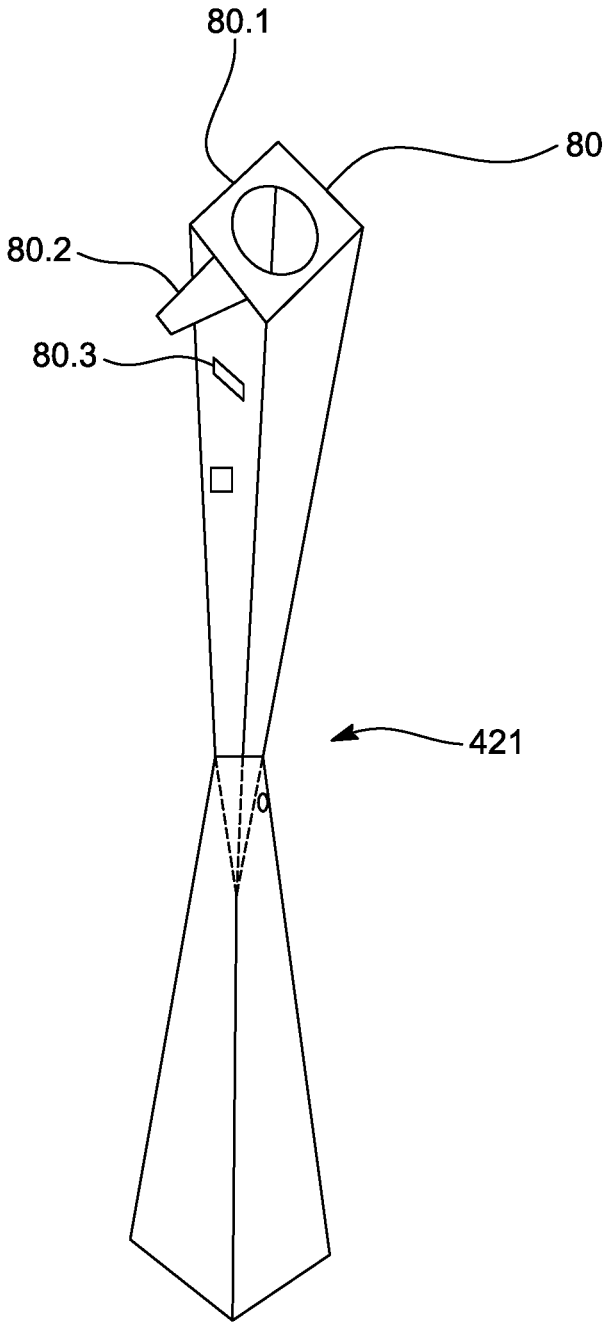
FIG. 2D is another top-perspective view of the embodiment of FIG. 2C.
Figure 2E:
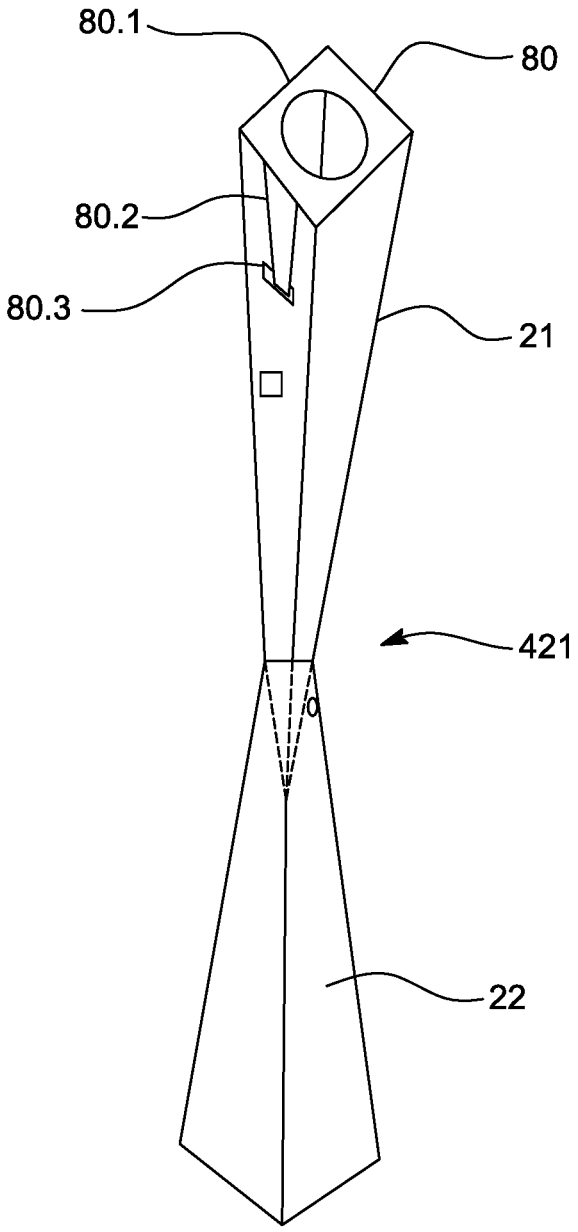
FIG. 2E is another top perspective view of the embodiment of FIG. 2C.

For example, FIG. 2D shows flap 80 extending over a top portion of water container 21 with flap 80.2 extending just outside of slot 80.3. FIG. 2E shows flap 80.2 extending into slot 80.3, thereby locking flap 80.1 across a top open portion of water container 21.

Figure 2F:
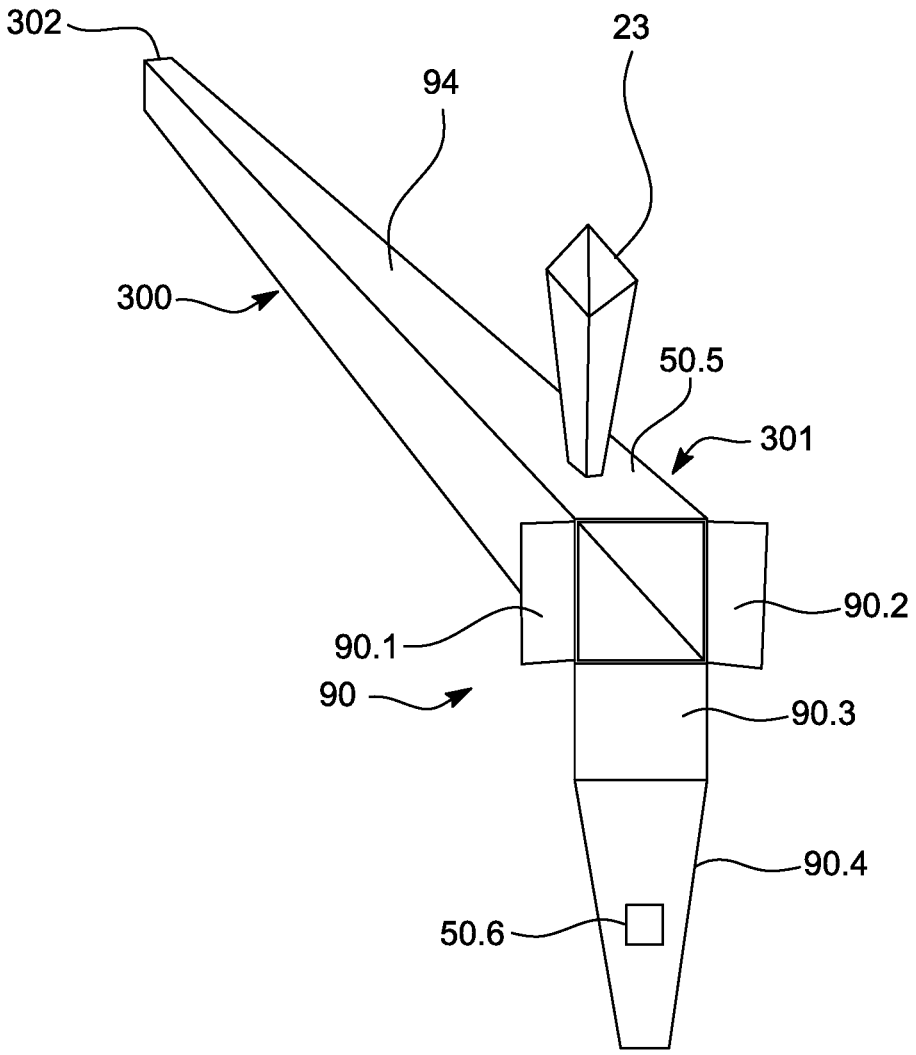
FIG. 2F is a top-perspective view of the embodiment of FIG. 2H with the end portion of a stem with open flaps.

FIG. 2F shows a perspective view of another embodiment which shows a body section 300 which is substantially pyramidal in shape. This pyramidal shape includes a first open end 301 and a second open end 302. Positioned at the first open end are a plurality of flaps. First flap 90.1 extends out of a first side. A second flap 90.2 extends out of an opposite side. Third flap 90.3 extends out of a third side which is transverse to either sides of flaps 90.1 and 90.2. A fourth flap 90.4 extends out of flap 90.3. Positioned inside of flap 90.4 is a hole 50.6. In addition, extending in hole 50.5 on side 94 is stem 23. Stem 23 is configured also to receive shield 24 if necessary. There is also a first side to body section 300, wherein first side 94 extends transverse to first end 301 or opening and open end 302. Thus, when a user places his or her mouth on an end such as open end 302, it creates a vacuum inside of stem 23 thereby allowing for air to be drawn into body section 300 thereby allowing for the smoking or inhaling of product placed in stem 23 or shield 24 positioned inside of stem 23.

Figure 2G:
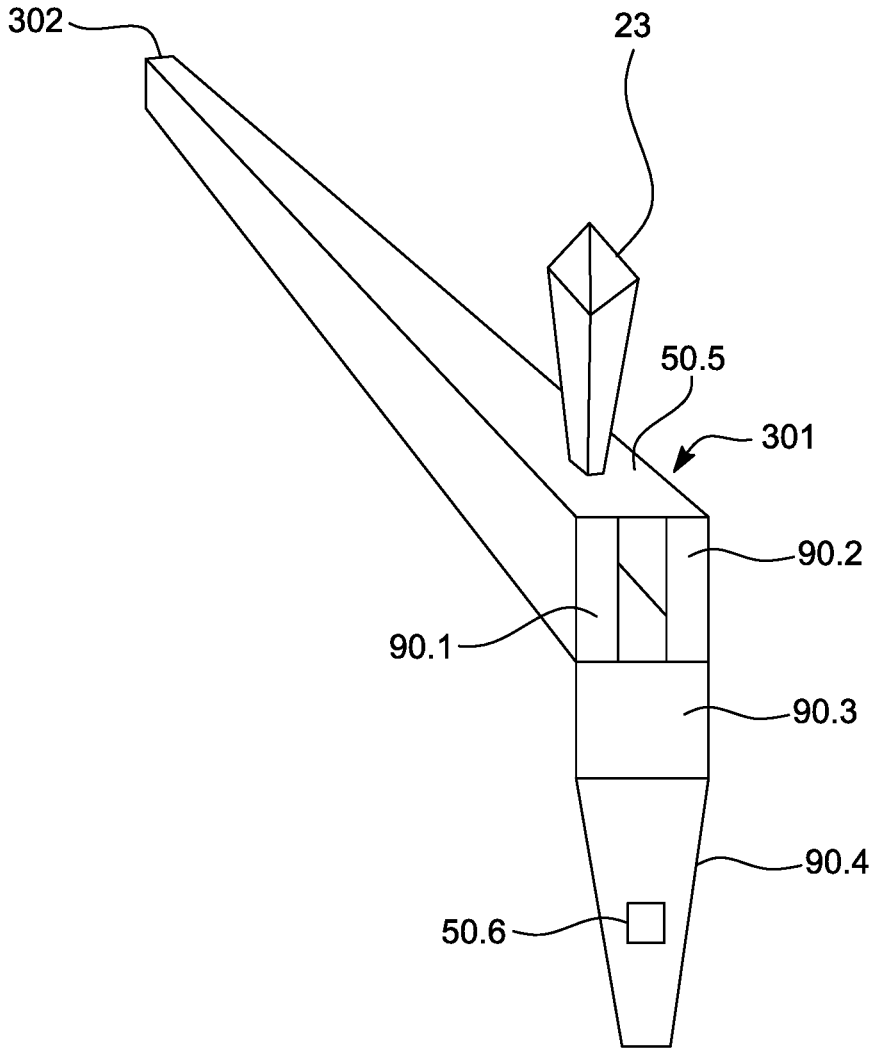
FIG. 2G is a view of the embodiment of FIG. 2F wherein the flaps on the end portion are forced inward.
Figure 2H:
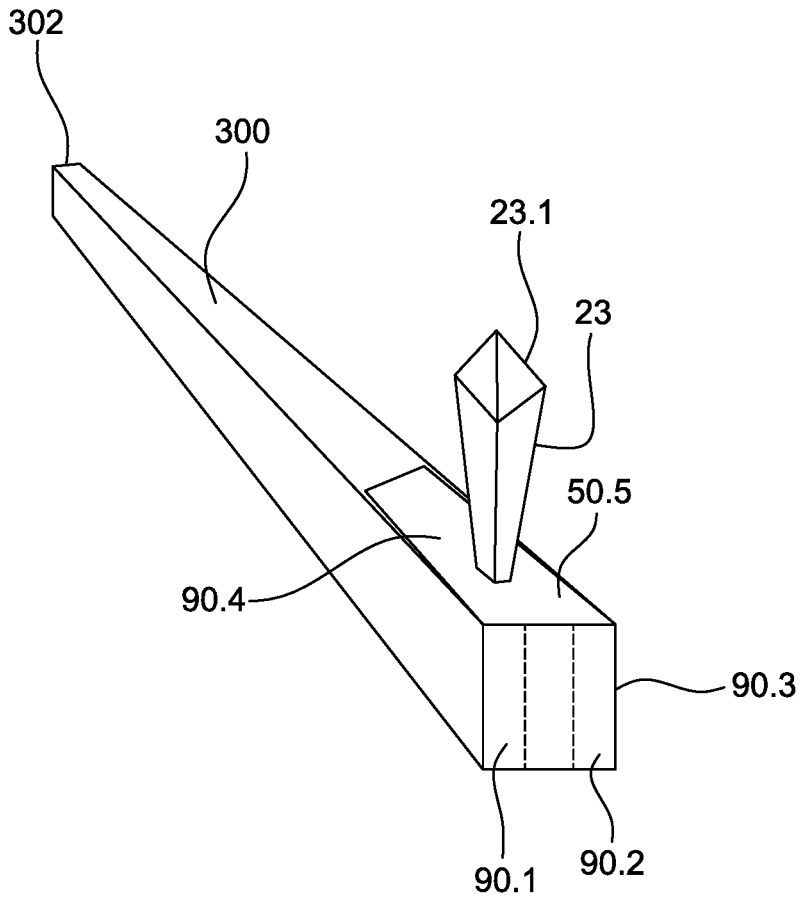
FIG. 2H is a view of a stem with hole wherein a smaller shield is inserted therein.

FIG. 2G shows another view of the embodiment of FIG. 2F. For example, in this fig. flaps 90.1 and 90.2 are folded over thereby at least partially covering first end of body section 300. FIG. 2H shows flap 90.3 and flap 90.4 folded over such that flap 90.4 extends across the surface adjacent to where stem 23 is inserted into body 300. Stem 23 inserts into both hole 50.6 and hole 50.5 (See FIG. 2H) thereby locking flap 90.4 to body 300. This locking of flap 90.4 to body 300 thereby closes the first end 301 of body 300.

As shown in FIG. 2H, the closure of body 300 thereby creates a pipe, wherein an open end 302 is open to allow a person to draw air through a top open end 23.1 in stem 23. Air when drawn through open end 302 extends into top open and 23.1. This air is drawn into pipe body section 300 and out of open end 302. Inside of stem 23 can be placed a shield 24 thereby allowing material such as tobacco or other smoke products to be inserted therein. The user can then light these products inside of a shield 24 sitting inside of stem 23 thereby allowing the user to smoke this product. In these or any other embodiments, the holes can be formed as circular, square, or rectangular or oval. With the case of rectangular holes, in at least one embodiment the long axis is a substantially vertical axis allowing for a stem to be fit into the hole with a substantially vertical orientation. With the case of oval holes, the stem can be fit in the hole with a substantially vertical orientation along the elongated vertical axis of the associated oval hole. Ultimately the stem is held in place by the shape of the opening in combination with the tip of the stem resting on the opposite wall of the vessel or base or body. The tip of the stem can be angled so that a bottom portion of the stem interacts with the inner wall of the associated base or water container to prevent the stem from rotating further and falling out of the hole.

Figure 3B:
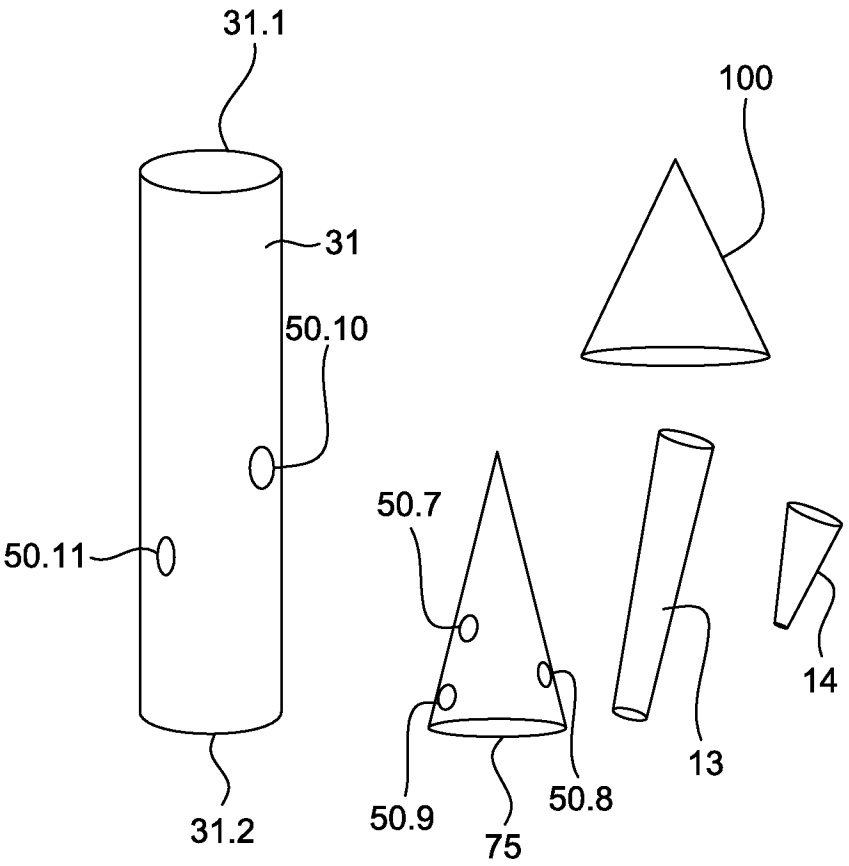
FIG. 3B is a side exploded view of another embodiment of the invention.
Figure 3A:
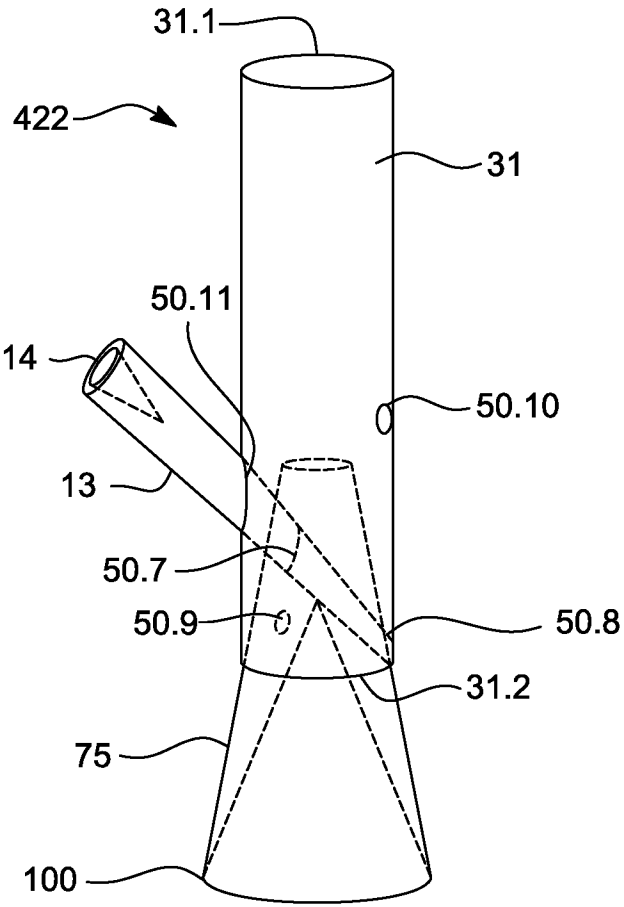
FIG. 3A is a side view of another embodiment of the invention.

FIGS. 3A and 3B show another embodiment. With this embodiment, there is a first base 100. First base 100 is conical shaped. Second base 75 is configured to fit over first base 100. Second base 75 has a plurality of holes 50.7, 50.8, and 50.9. These different holes are at different orientations in different elevations. For example, hole 50.7 is on a first elevation for hole 50.8 is at a second elevation and hole 50.9 is in the third elevation. Holes 50.7 and 50.9 substantially on one side of base 75 will hole 50.8 is substantially on an opposite side of base 75. There is also a cylindrical base 31 which includes at least two holes 50.10 and 50.11. A stem 13 and a shield 14 is also shown. Stem 13 is substantially frustoconical as well as shield 14 is also substantially frustoconical. Cylindrical base 31 has two open ends 31.1 and 31.2. Cylindrical base 31 fits over both base 75 as well as at least a portion of base 100. Base 75 sits on top of base 100 thereby offering further stability. Stem 13 fits inside of at least two holes for example hole 50.11 as well as holes 50.7 and 50.8. With the view shown in FIG. 3A, stem 13 fits inside of hole 50.11, through hole 50.7, and then through hole 50.8. Hole 50.10 then offers further aeration in cylindrical base 31. Therefore, the user can place his mouth over hole 31.1 draw air into his mouth through hole 31.1 thereby drawing air into stem 13 pulling air through stem 13 from inside of cylindrical base 31. Air being drawn from end 31.1 is drawn through an open end of stem 13 as well as through hole 50.10. However, hole 50.10 is small enough such that a vacuum effect is still formed thereby drawing air into stem 13. This allows for the creation of a vacuum effect thereby drawing air through stem 13 to allow for smoking of material that can be placed inside of shield 14. When stem 13 is inserted entirely through the associated holes a bottom portion of the stem interacts with cylindrical base 31 to lock the stem from further rotation, which prevents the stem from rotation down and thereby losing its upward oriented angle. The wedging of these parts as well as the other parts together creates a foldable, portable self-interlocking device which does not require any additional glue or adhesives. Thus, the design remains simple to assemble and use for any user.

Figure 4B:
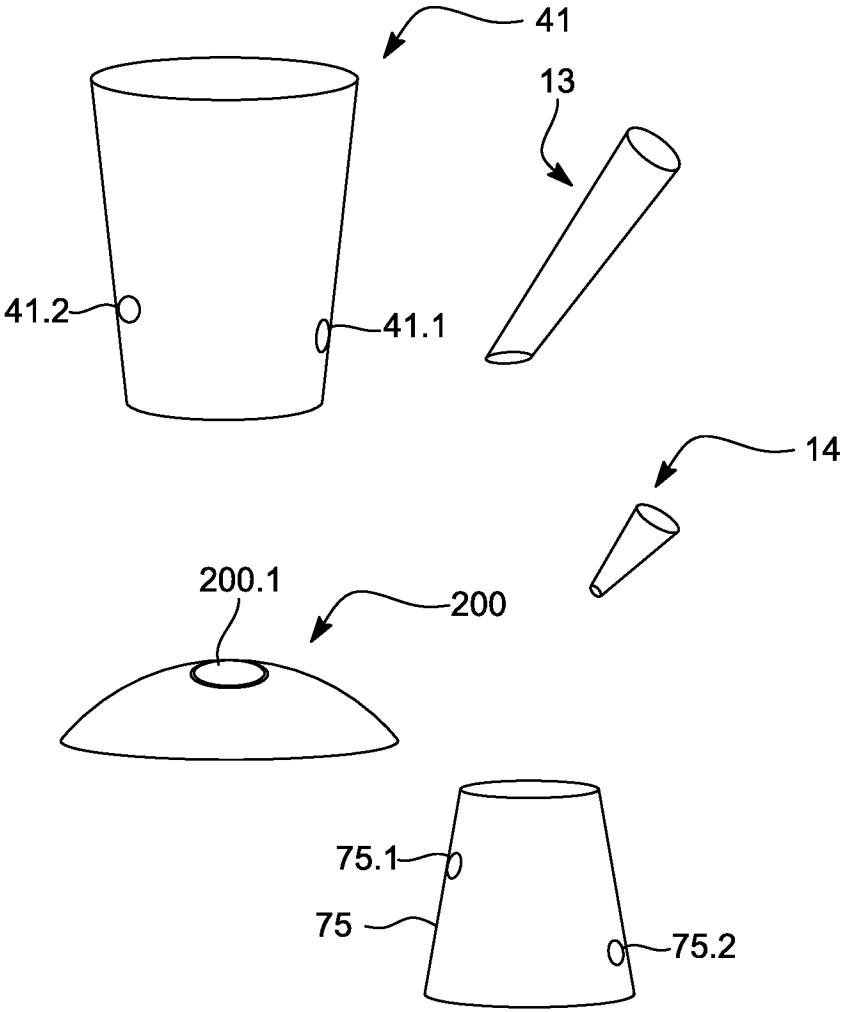
FIG. 4B is a side exploded view of the embodiment of FIG. 4A.
Figure 4A:
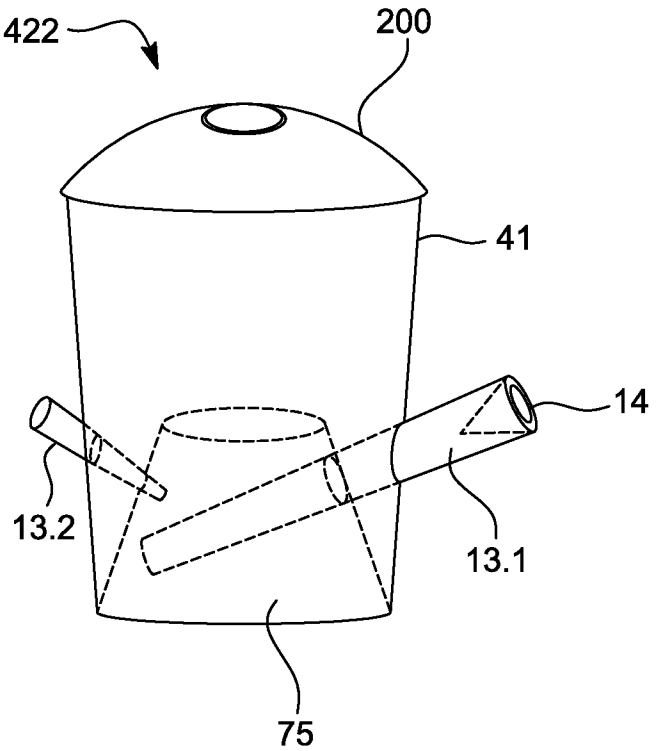
FIG. 4A is a side view of another embodiment of the invention.

FIGS. 4A and 4B are views of another embodiment. With this embodiment 422, there is shown a base cup 41, and a top 200. As shown in FIG. 4B top 200 has a top hole 200.1. Cup or base 41 includes holes 41.2 and 41.1. There is also a stem 13 shield 14 as well as an additional base support 75. Base support 75 includes a plurality of holes 75.1 and 75.2. Base support 75 has an open bottom end and an open top end. Each of holes 75.1 and 75.2 are configured to be able to receive an associated stem such as stems' 13.1 and 13.2. When stem such as stem 13.1 is inserted into a hole such as hole 41.1 it can then also insert in the hole 75.2 thereby allowing stem 13.1 lock base 75 as well as base 41 together. With this design the user can place his mouth over top 200 drawing air in through hole 200.1 thereby creating a vacuum inside of cup or base 41 thereby drawing air through stem 13 into cup or base 41 through base 75 and out of hole 200.1. The drawing of air through hole 200.1 creates a vacuum in stem 13 and also in shield 14 thereby creating a pulling effect on any tobacco-based product or smokable product disposed in shield 14.

FIGS. 5A, 5B, 5C, 5D, 5E and 5F shows a various assortment of elements which can be used to assist a user and smoking a tobacco-based product or other smoke smokable products. With this design shown in FIG. 5A there is shown a stem 13 with a shield 14 as well as a body 300 having a first hole 300.1 (See FIG. 5E).

Figures 5A, 5B, 5C, 5D, 5E, 5F:
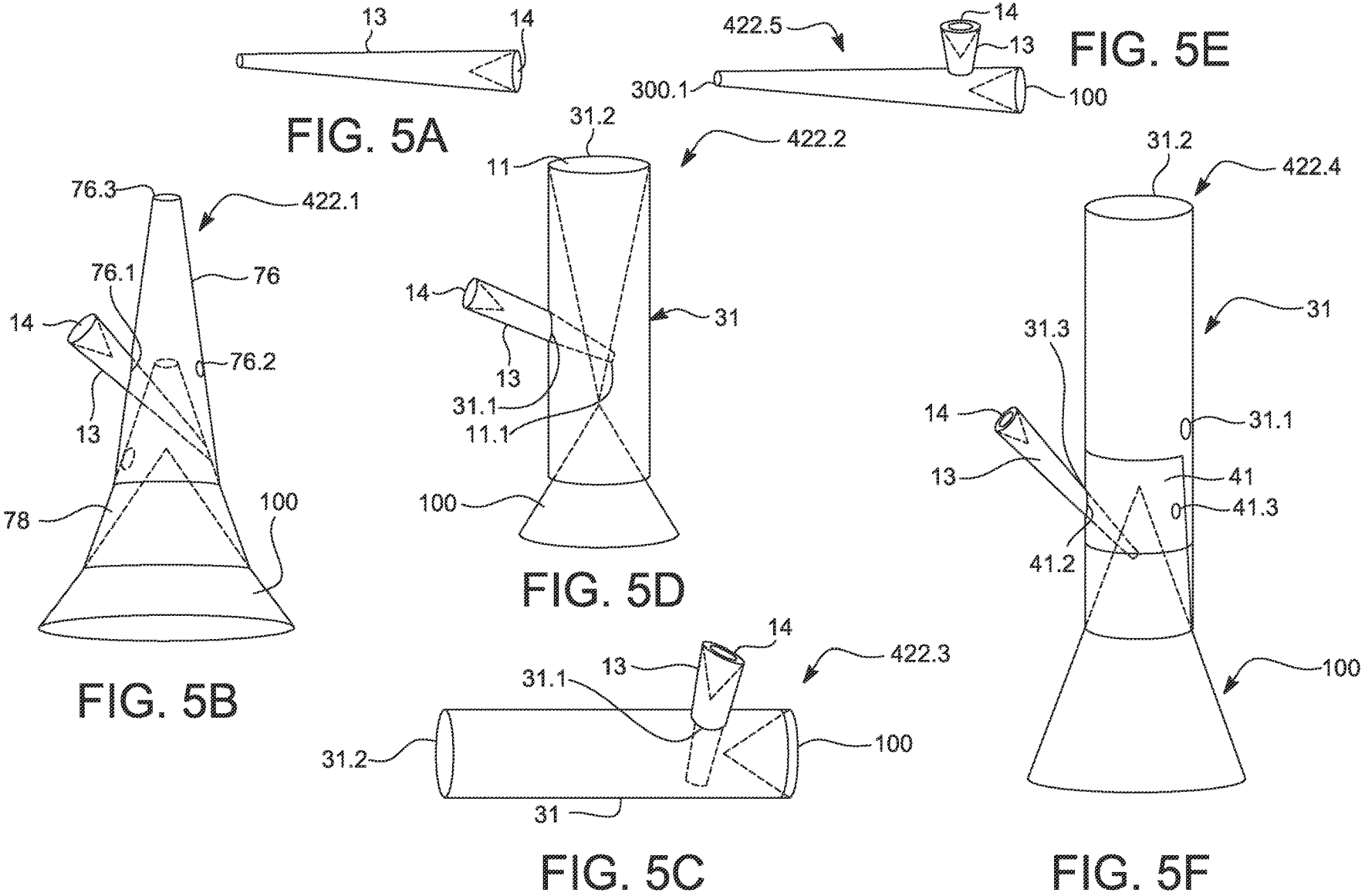
FIG. 5A is a side view of another embodiment of the invention.
FIG. 5B is a side view of another embodiment.
FIG. 5C is a side view of another embodiment.
FIG. 5D is a side view of another embodiment.
FIG. 5E is a side view of another embodiment.
FIG. 5F is a side view of another embodiment.

In FIG. 5E there is a base 100 can be inserted into body 30. Base 100 can be used to close the first end of body 300. Second open-end 300.1 allows the user to put his mouth on that and to draw air in. Another stem 13 can be inserted inside of body or base section 76. Stem 13 is configured to receive shield 14. Stem 13 is substantially frustoconical in shape while shield 14 is also frustoconical in shape. When user draws air in through hole 300.1 it creates a vacuum in shield 14 thereby drawing air through shield 14 stem 13 and into a body section of body 300. Thus, this design creates a pipe type effect in the embodiment 422.5.

In the embodiment 422.1, (See FIG. 5B) there is a first base 100 which is substantially conical in shape. Next, there is another base 78 which is substantially frustoconical in shape having a first open end and a second wider bottom open-end. The bottom open-end frustoconical base section 78 is configured to fit over first base 100 which can be conical in shape. Another frustoconical section 76 has a first wider open and an open top end. Frustoconical base section 76 has a plurality of holes including a first hole 76.1 a second hole 76.2. First hole 76.1 is configured to receive stem 13 which holds shield 14. Stem 13 extends through base 78 as well as base section 76 thereby locking these two base sections together when user places his mouth over an open and 76.3, it creates a vacuum in base section 76 thereby drawing air through shield 14 as well as stem 13. The vacuum created pressure in shield 14 and stem 13 draws air through the stem 13 thereby allowing for smoking of a tobacco or smokable product.

With the embodiment 422.2 shown in FIG. 5D, cylindrical base 31 which is coupled to first base 100 which can be substantially conical in shape. Cylindrical base 31 is substantially cylindrical in shape and does not have to be formed as a perfect cylinder, it can also be formed as substantially frustoconical as well. An additional conical water container 11 is inserted upside down in cylindrical base 31. A stem 13 inserts into cylindrical base 31 through hole 31.1 stem 13 inserts into hole 31.1 and also inserts into water container 11. Conical water container 11 is secured to cylindrical base 31 via the insertion of stem 13 through hole 31.1 as well as a hole 11.1. When user places his mouth on and 31.2 and draws air in, this creates a vacuum effect in shield 14 as well as stem 13 thereby drawing air through shield 14 into cylindrical base 31. This allows a smokable product to be inserted into shield 14.

With the embodiment 422.3 shown in FIG. 5C, there is shown a cylindrical base 31 having first base 100 which is substantially conical inserted into an end thereof. An open and 31.2 allows for user to put his or her mouth on cylindrical base 31. Cylindrical base 31 has an opening 31.1 which allows for receiving stem 13. Shield 14 is insertable into stem 13. Both stem 13 and shield 14 are substantially frustoconical in shape. Thus, when user places his or her mouth on open-end 31.2 drawing air in, it draws air in two shield 14 through stem 13 into a body of cylindrical base 31 thereby allowing for smoking of any product disposed inside of shield 14.

With the embodiment 422.4 shown in FIG. 5F, there is shown cylindrical base 31, having open-end 31.2. Cylindrical base 31 also has an opening 31.1, as well as another opening 31.3. Opening 31.3 is configured to receive stem 13 which houses shield 14. Disposed inside of cylindrical base 31 is a substantially frustoconical base or cup or base 41. Frustoconical base 41 has an opening 41.2 as well as a second opening 41.3. Frustoconical base 41 is locked to this cylindrical base 31 via stem 13 inserting into holes 41.2 and 31.3. Thus, when user places his mouth on open-end 31.2 it draws air through shield 14 and stem 13 into cylindrical base 31. A hole 31.1 also allows for selective entry of air into an interior region of cylindrical base 31. The bottom of base 41 it is sealed by first base 100 which has a closed top end. Thus, water can be inserted into a region of frustoconical base 41 as well as inside of cylindrical base 31. Thus, base 31 as well as base 41 form a water containing region. Base 100 forms a base section closing off water containing region. In open-end 31.2 allows a user to place his mouth over open and 31.2 to draw air and create a vacuum effect in a chamber of cylindrical base 31. Air is drawn through shield 14 and stem 13 into cylindrical base 31 thereby allowing the smoking of or an inhalation of product in shield 14.

Figure 6:
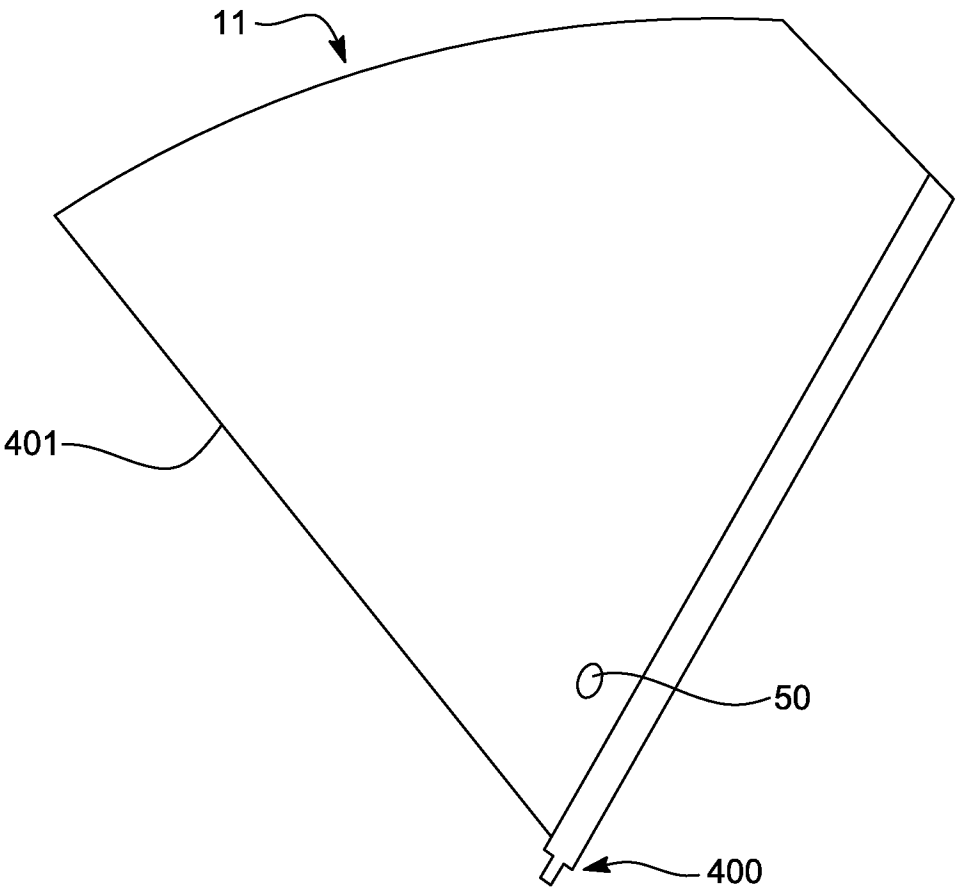
FIG. 6 is a side flattened view of another embodiment of the invention with a conical water container template or sheet.

FIG. 6 shows a template of a conical water container. Substantially conical water container 11 is formed via flat sheet, having a hole 50, as well as an adhesive strip 400. To assemble conical water container 11, the user can peel away a cover for adhesive strip 400 thereby exposing this adhesive strip. The user can curl an end opposite of adhesive strip 400 to thereby form a cone which is sealed by adhesive strip 400. Therefore, opposite end 401 is curled in a radial manner to meet with adhesive strip 400 thereby forming a cone from the flat sheet. With this design, conical elements such as conical water container 11 can be formed from flat sheets and presented as a series of flat sheets and a kit.

Figure 7:
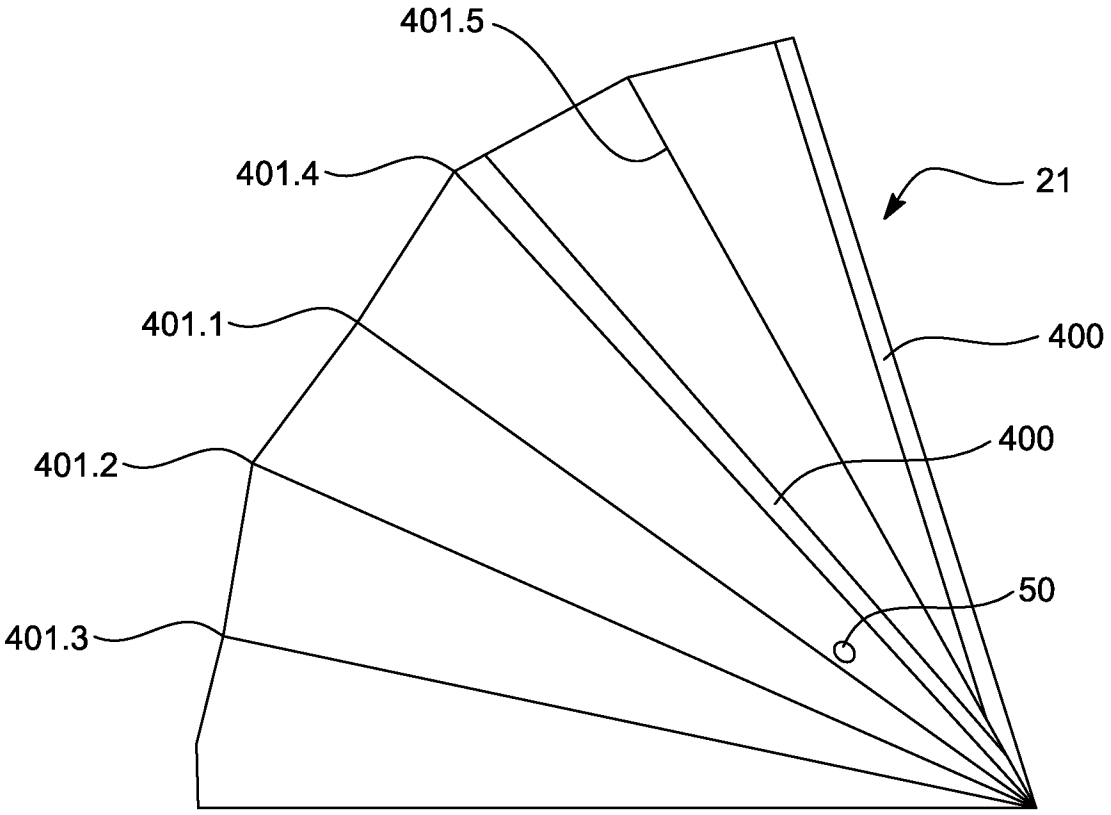
FIG. 7 is a side view of another embodiment of the invention with a pyramidal template or sheet of a water container.

FIG. 7 shows a flat sheet for creating pyramidal water container 21. With this design, there are plurality of adhesive strips 400, which allow for the folding along fold lines 401.1, 401.2, 401.3, 401.4, 401.5, to finally adhere these fold lines to adhesive strips 400.

Figure 8:
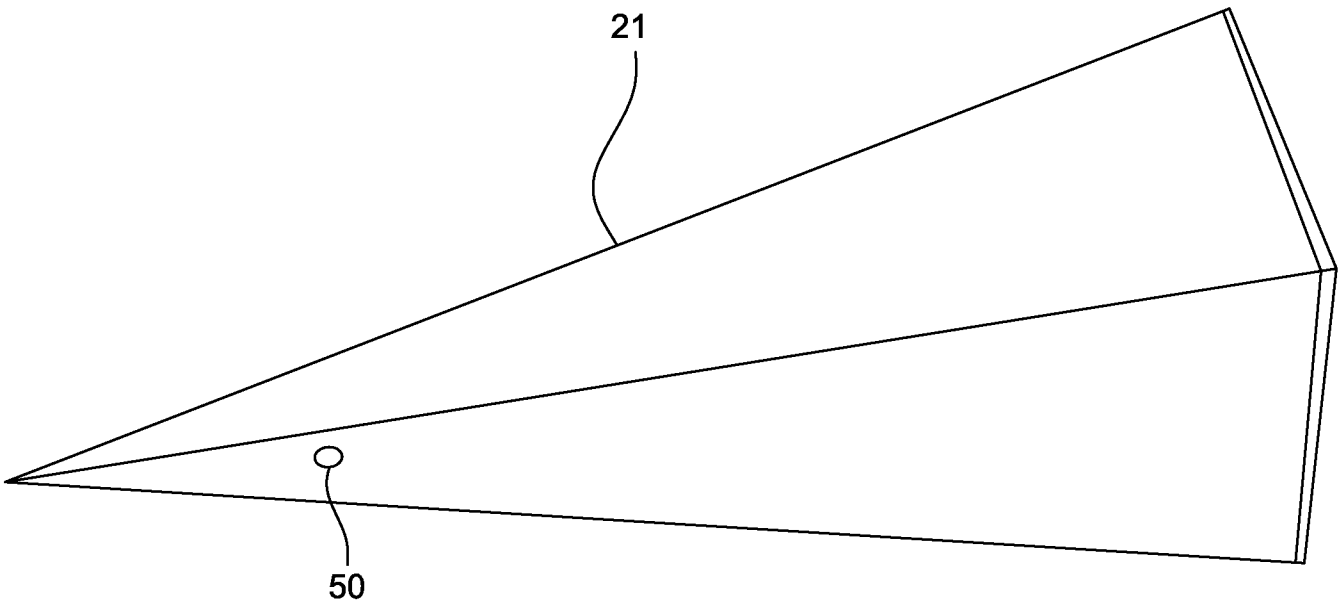
FIG. 8 is a side view of the embodiment of FIG. 7 folded and flattened.
Figure 9:
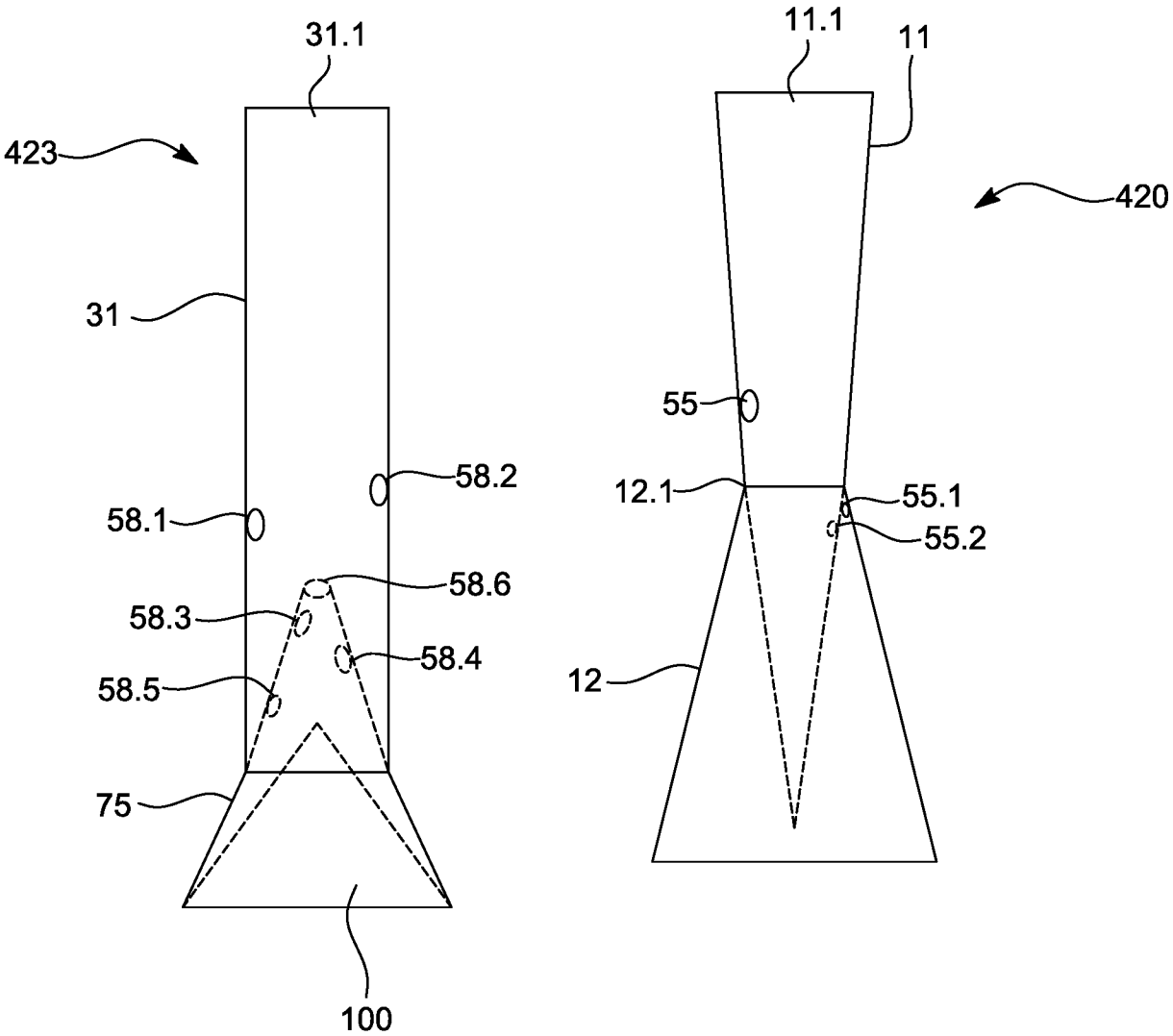
FIG. 9 is a side view of a new embodiment.

FIG. 8 shows a side view of pyramidal water container 21 assembled and flattened having hole 50. FIG. 9 shows another embodiment 423 which includes a cylindrical base 31 having holes 58.1 and 58.2. Cylindrical base 31 is configured to fit over frustoconical base 75. Disposed inside of frustoconical base 75 is first base 100. Frustoconical base 75 includes a plurality of holes including the first hole 58.3, second hole 58.4, a third hole 58.5. There's also top hole 58.6. With this design, the stem can be inserted into hole 58.1, then through hole 58.3, then through hole 58.4. The user placing his mouth on a top end 31.1 can then create a vacuum effect thereby drawing air through holes 58.1 or 58.2. If stem is inserted in the hole 58.1, hole 58.2 serves as a pressure regulator where user can selectively open and close pressure regulator 58.2 to allow air to selectively flow inside of cylindrical base 31. Cylindrical base 31 can be used as a water container, which sits on top of base 100. In addition, another embodiment 420 shows substantially conical water container 11 having hole 55 meshing with substantially conical base 12. Substantially conical water container 11 is inserted into an opening 12.1 of frustoconical base 12. With this design, water container 11 has at least two holes 55.1 and 55.2. In addition, base 12 has a hole 55.1. With this design a stem such as stem 13 can be inserted into hole 55.1 and then in the hole 55.2 thereby locking water container 11 to base section 12.

Thus, when a user puts his mouth on open-end 11.1, it can draw air into a stem 13 thereby drawing air through hole 55.1, through hole 55.2, and out of hole 11.1. Hole 55 and water container 11 can then serve as a pressure regulator which can be selectively open and close by a user's finger.

Figure 10:
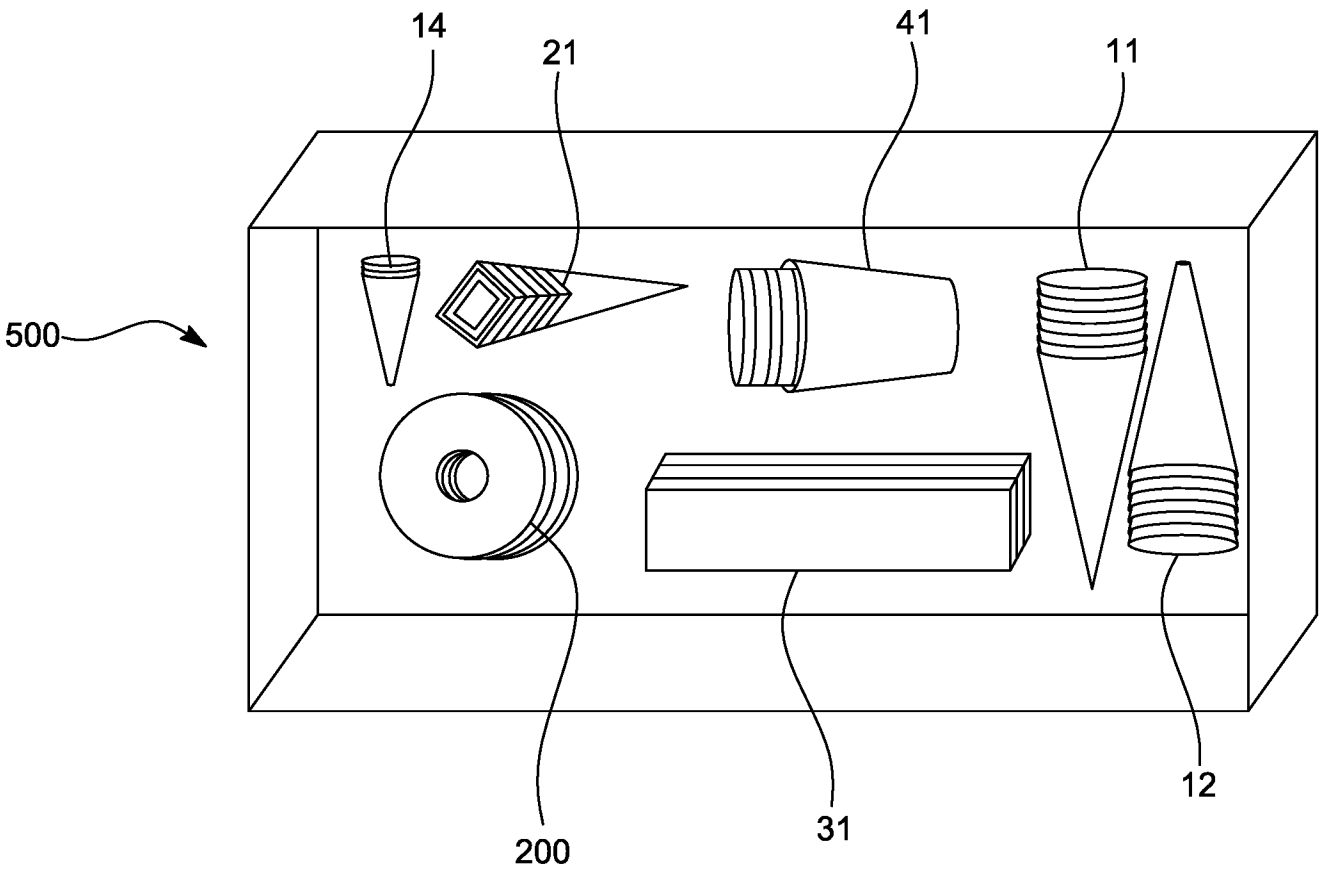
FIG. 10 is a side view of the kit.

FIG. 10 shows a kit which is essentially a box 500 which includes a plurality of shields 14, a plurality of water containers 21 cup or base 41 water container 11 base 12 and cylindrical base 31. There are also a plurality of tops 200 stack therein. With this kit these different designs can be put together to form either a pipe or a water pipe.

Figure 11:
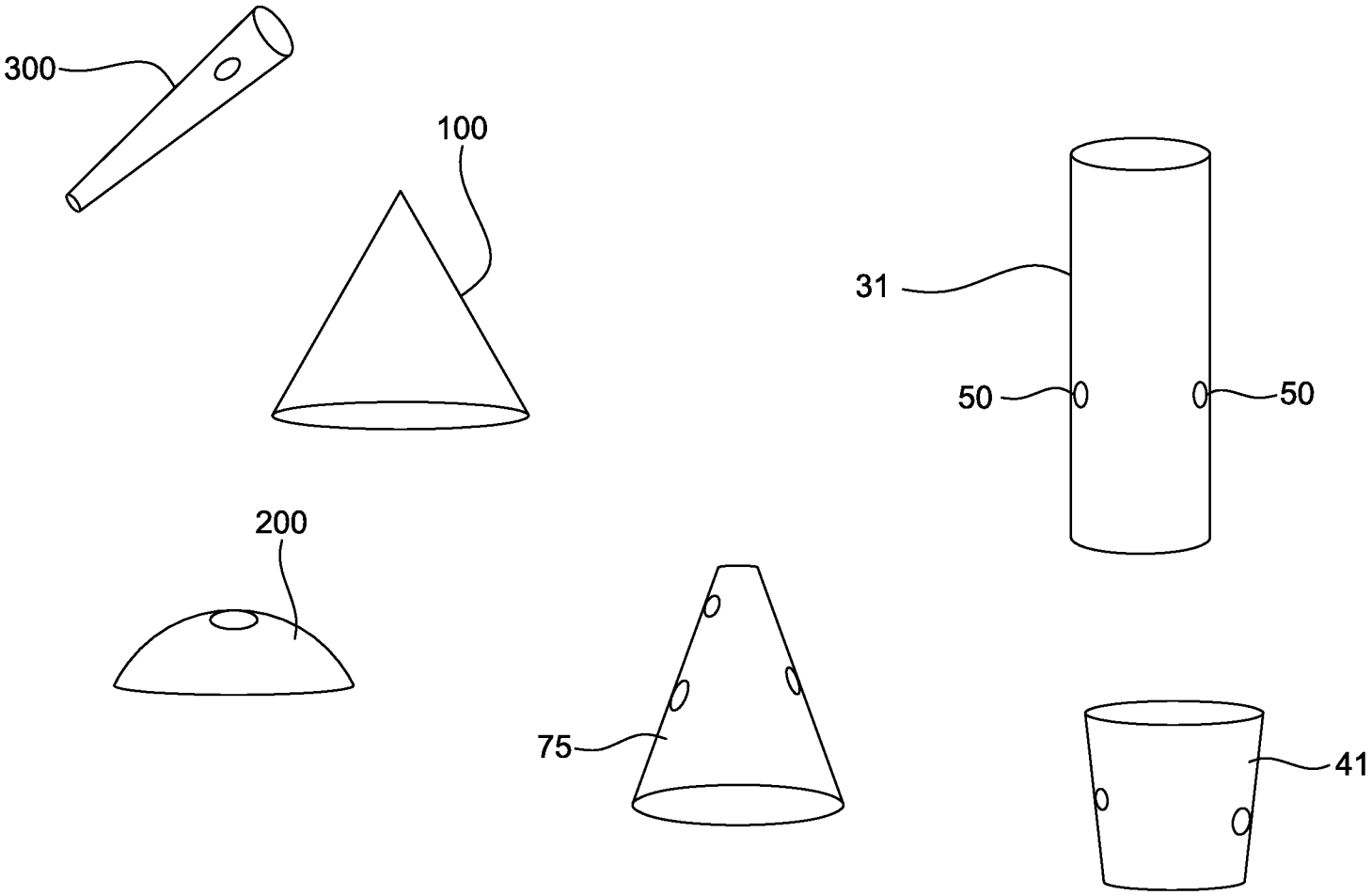
FIG. 11 is a side view of the components of the kit of FIG. 10.

FIG. 11 shows an exploded view of all of these components including body 300 forming a pipe, a first base 100, a substantially conical top 200 which is substantially dome-shaped, base section 75 which is substantially frustoconical in shape, cup or base 41 which is substantially frustoconical in shape and cylindrical base 31 which is substantially cylindrical in shape.

Figure 12:
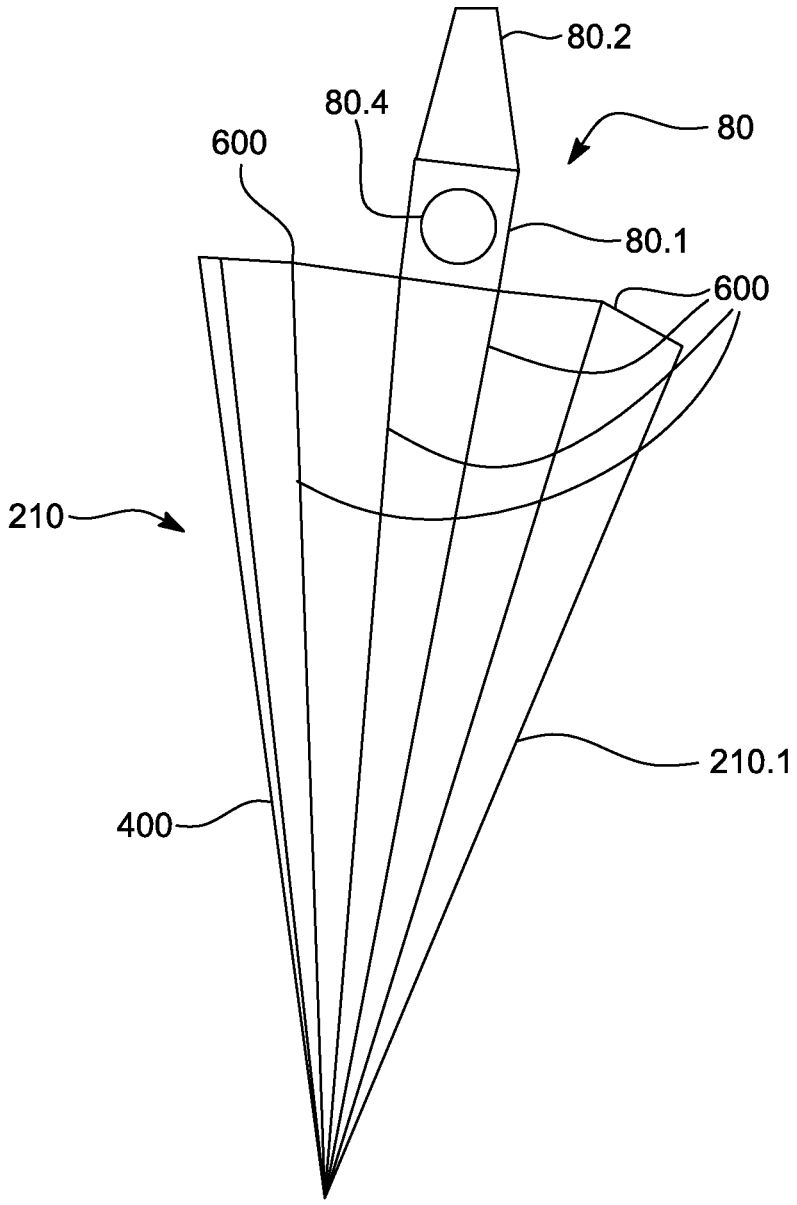
FIG. 12 is a template view of an embodiment of FIG. 2C.

FIG. 12 shows an unfolded view of water container 210 which has a plurality of fold lines 600 as well as a plurality of flaps. These flaps include flap 80.1, and flap 80.2. Flap 80.1 includes a hole 80.4. When water container 210 is folded along fold lines or crease 600 an end or edge 210.1 can be fastened to an adhesive strip 400 to allow for the securing and formation of a substantially water container 210. Thus, this device can be shipped and stored flat and then can be eventually folded to form a water container or pipe section to allow user to smoke smokable material therein.

Figure 13:
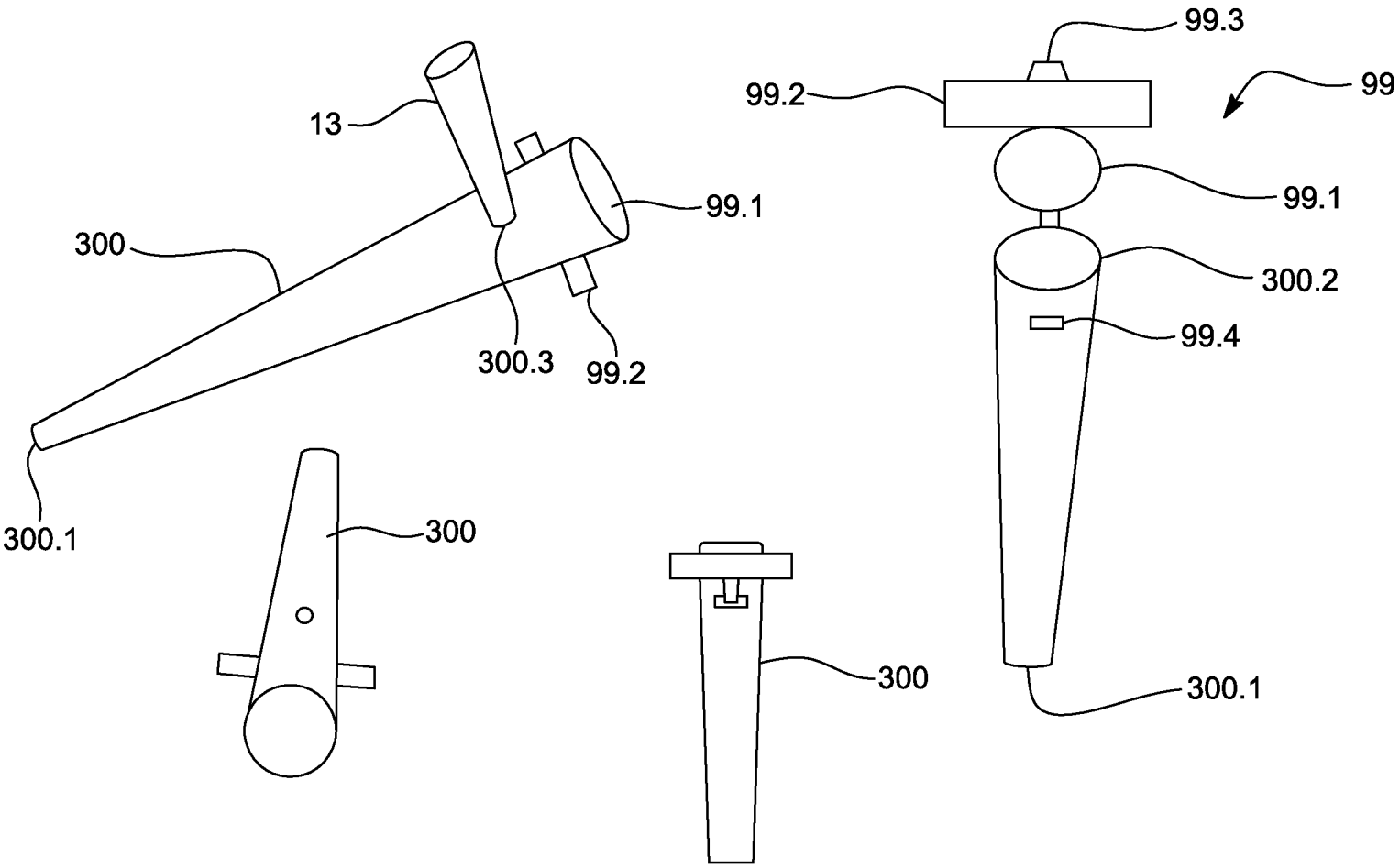
FIG. 13 is an exploded side view of another embodiment.

FIG. 13 shows body 300 having stem 13 inserted therein. Body 300 is frustoconical in shape and has an open end 300.1 as well as an opposite open-end 300.2. Plurality of flaps 99.1, 99.2, 99.3 extend out from end 300.2. Flaps 99.1, 99.2, 99.3 can fold over open-end 300.2 with and flap 99.3 inserting into notch 99.4. With this design, the user can stick a stem 13 into a hole 300.3 with a closed end at end 300.2. Thus, when a user draws air in through hole 300.1 creates a vacuum in stem 13 thereby drawing air through stem 13 into a body 300 thereby creating a pipe out of body 300 and stem 13. Thus, a user can insert smokable material such as tobacco or other usable material into stem 13 and particularly inside of a shield 14 such that this material inside of shield 14 can then be smoked.

Thus, there is shown plurality of different designs which all show a portable customizable and configurable device for allowing for the smoking of different smokable products.

Figure 14A:
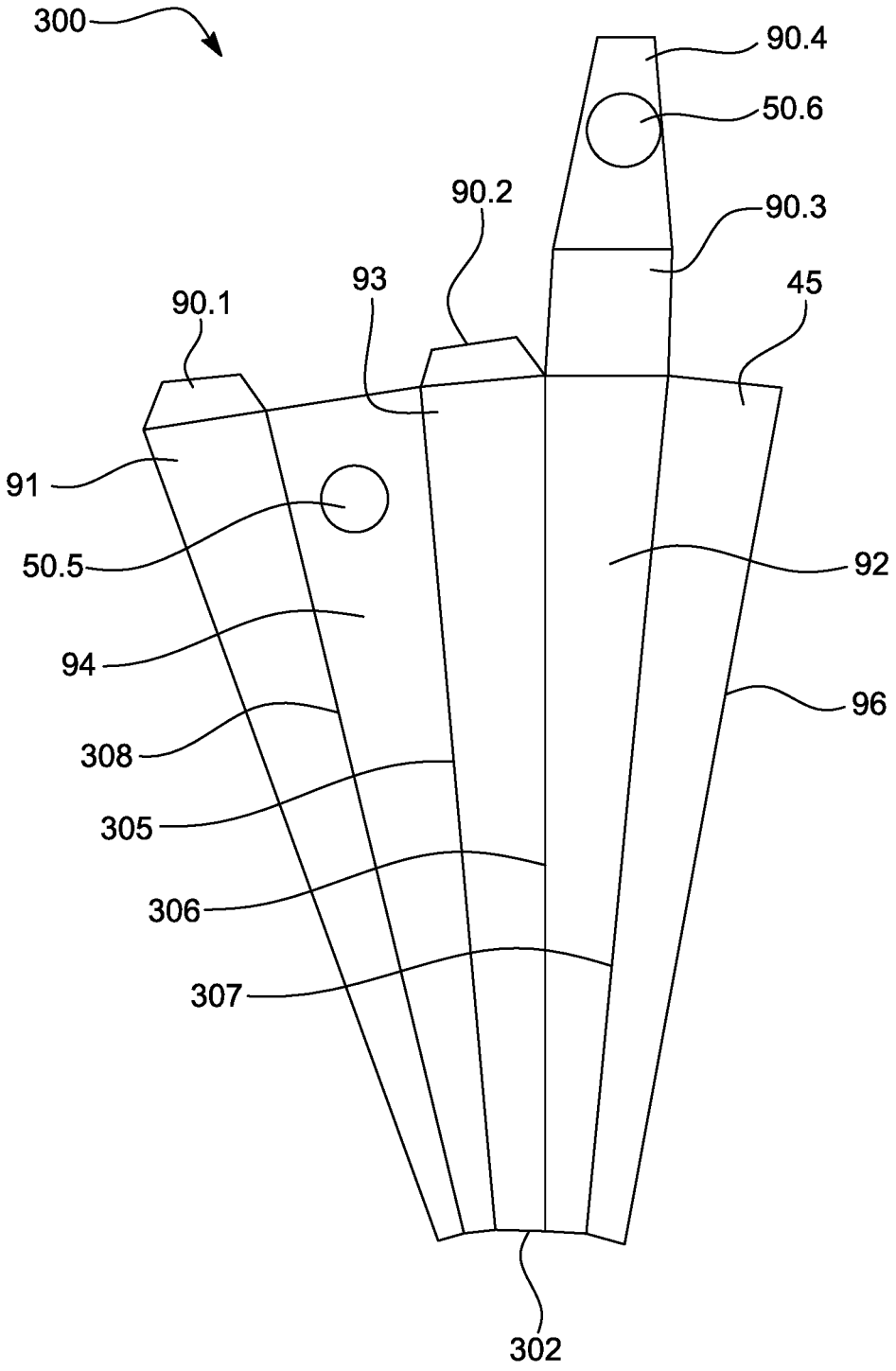
FIG. 14A is a side view of a flat sheet configured to make a pipe.

FIG. 14A shows another view of the embodiment of FIG. 2F. With this design, there is shown a pipe body 300 which is substantially square or rectangular in cross-section and which has a plurality of different sides including sides 91, 92, 93, 94, and 95 formed by a plurality of different creases or fold lines 308, 305, 306, and 307. The flat sheet can be folded along these fold lines 308, 305, 306, and 307 to form this pipe with four different sides and a substantially rectangular cross-section. There is also shown flaps 90.1 and 90.2 as well as flaps 90.3 and 90.4 These flaps can be used to fold in to close an end as shown in FIGS. 2G and 2H to form an assembled pipe.

Figure 14B:
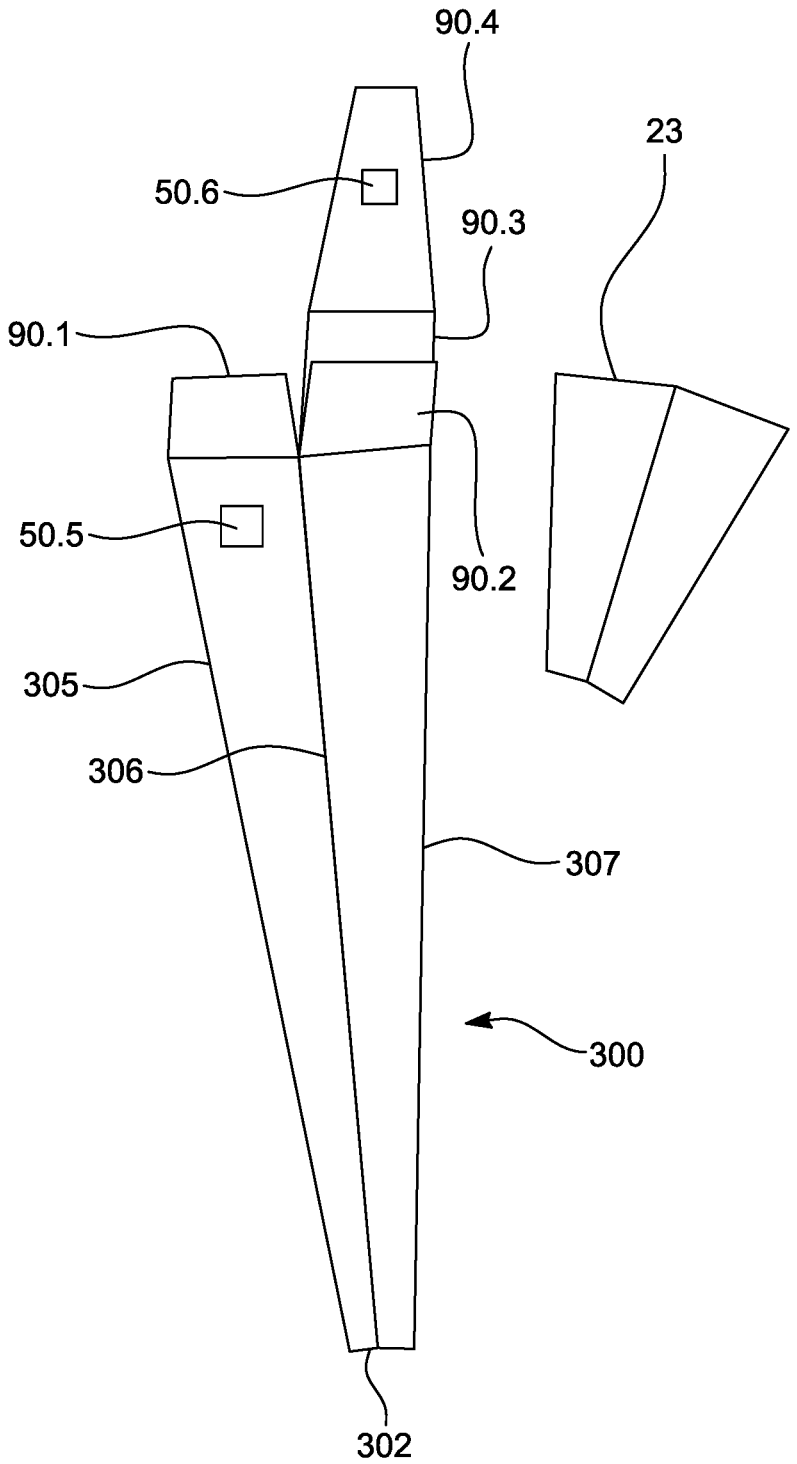
FIG. 14B is the assembled pipe folded flat with associated shield.

FIG. 14B shows the pipe body 300 folded flat having flaps 90.1 and 90.2 as well as flaps 90.3 and 90.4 shown. Holes 50.6 and 50.5 are also shown with a shield, 23 folded flat. This view shows that the different crease or fold lines such as fold lines 305, 306, and 307 to allow for the pipe to be folded flat and to be stored in a confined manner.

Figure 15A:
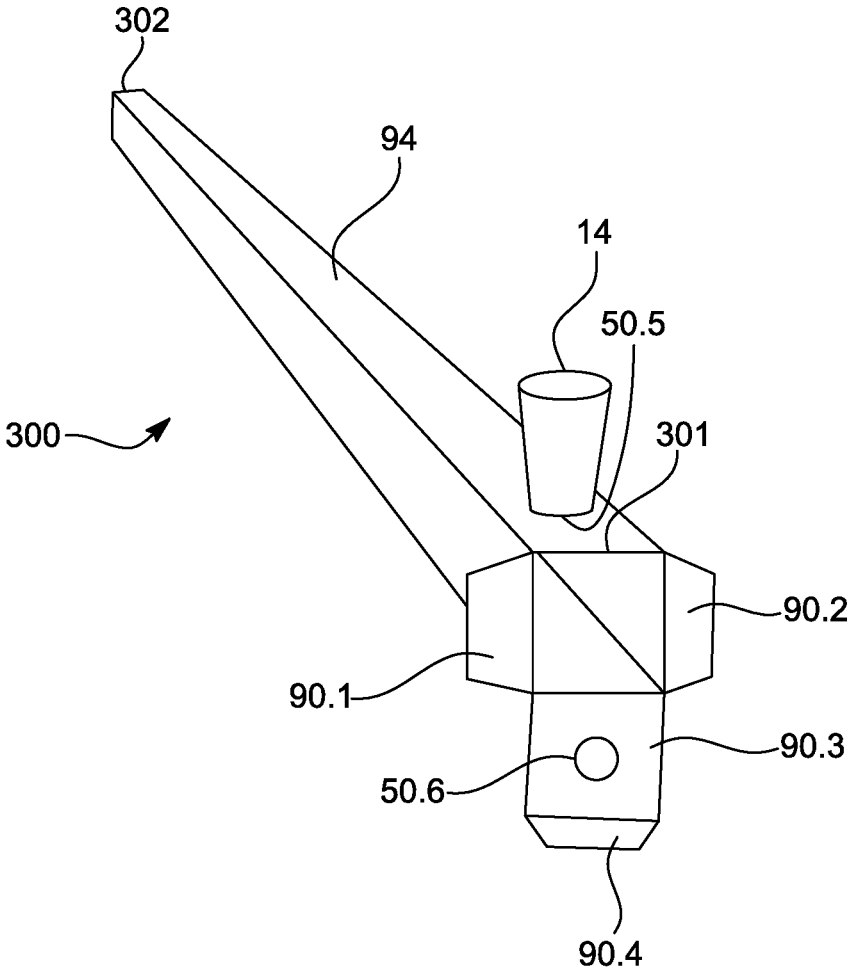
FIG. 15A is an end perspective view of an embodiment of the pipe with a flap open at one end.
Figure 15B:
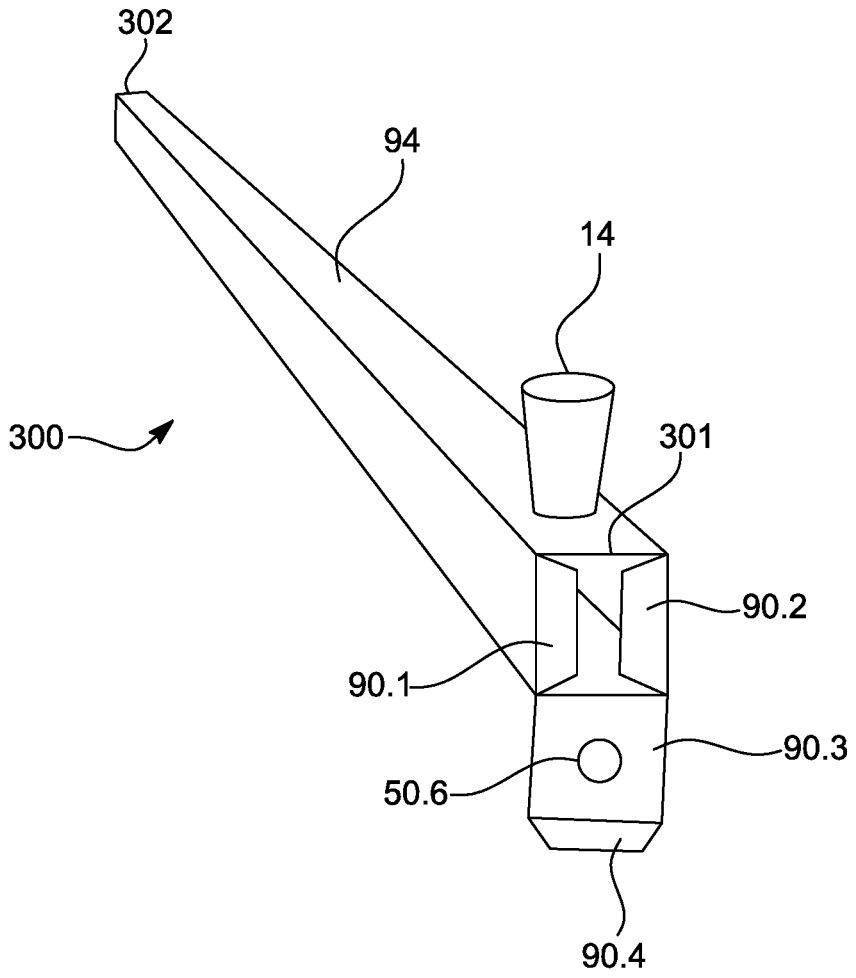
Figure 15C:
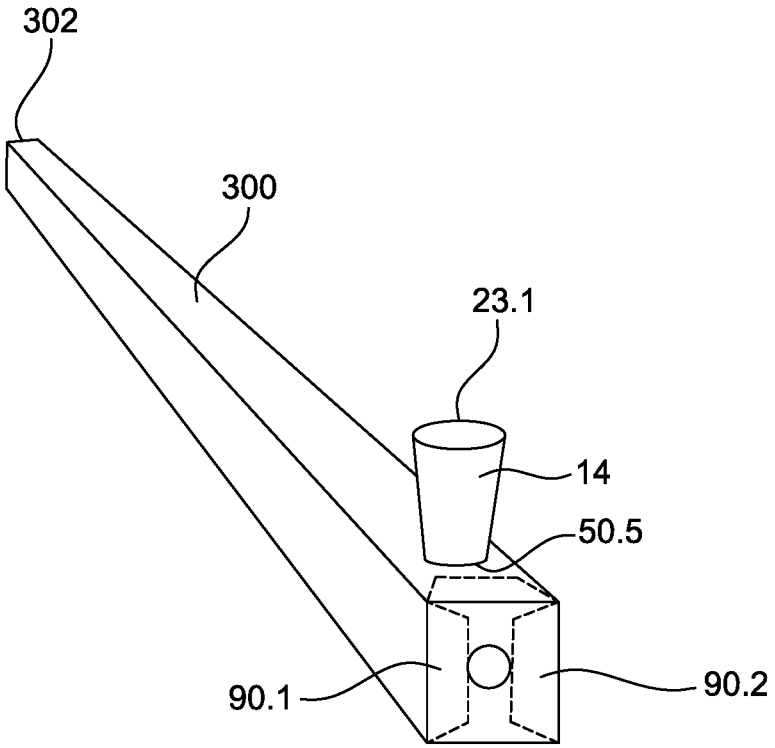
FIG. 15C is an end view of the embodiment of FIG. 15A with the end flap folded up.
Figure 15D:
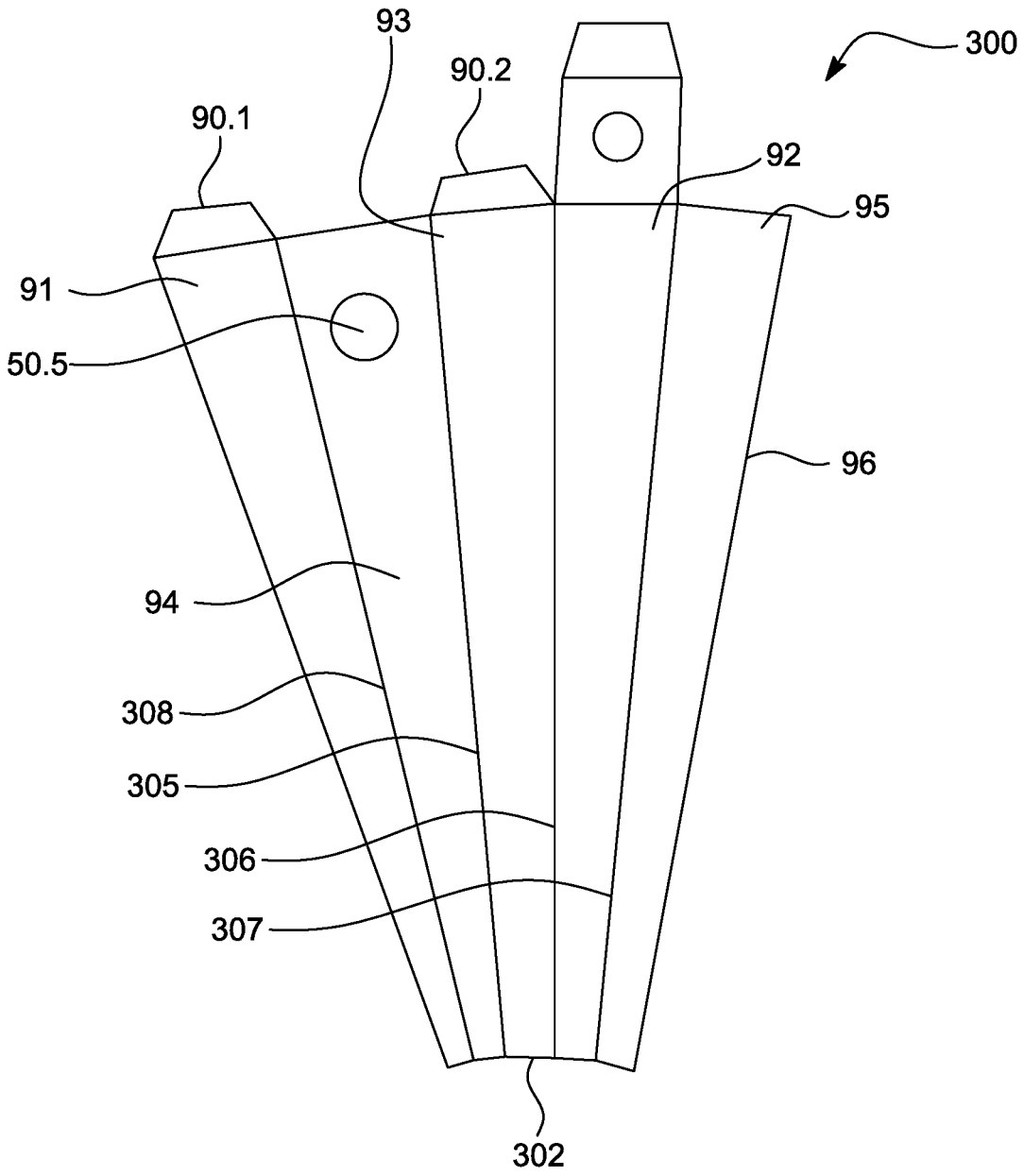
FIG. 15D is a flattened template view of the pipe of FIG. 15A.
Figure 15E:
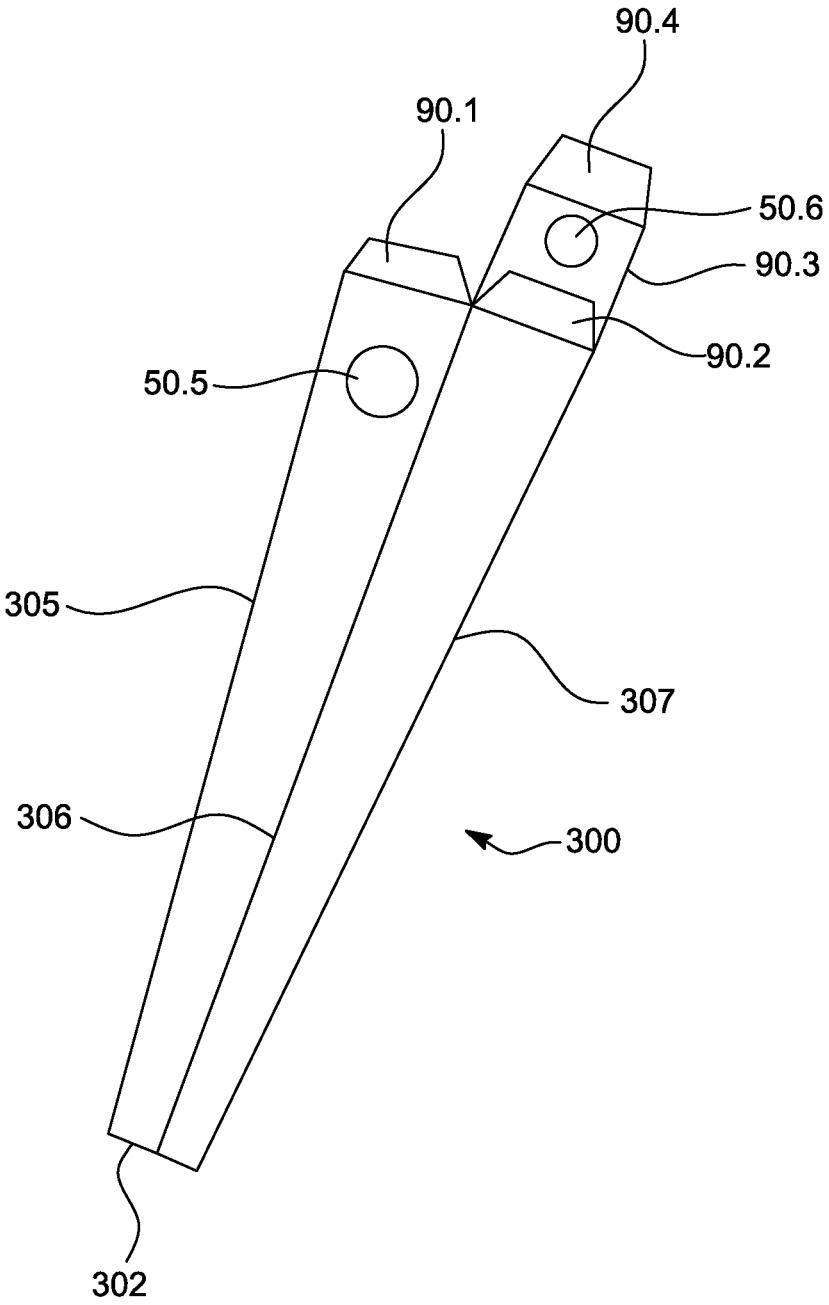
FIG. 15E is a side semi-assembled view of the embodiment of FIG. 15A.

FIG. 15A is an end perspective view of an embodiment of the pipe with a flap open at one end, while FIG. 15B is an end perspective view of the embodiment of FIG. 15A with side flaps folded in. For example, there is shown a body 300 having a first end 301 and a second end 302 as well as a plurality of creases 304, 305, 306, 307 and 308. There are also corresponding sides 91, 92, 93, 94, 95, 96. A plurality of holes 50.5 and 50.6 are positioned in the body, while there are also a plurality of flaps such as side end flap 90.1, side end flap 90.2, top middle flap 90.3 and top end flap 90.4. FIG. 15C is an end view of the embodiment of FIG. 15A with the end flap 90.3 and 90.4 folded up. In addition, FIG. 15D is a flattened view of the water pipe of FIG. 15A; FIG. 15E is a side semi-assembled view of the embodiment of FIG. 15A wherein this view shows holes 50.5 and 50.6 as well as creases 305, 306 and 307 in body 300. In addition, flaps 90.1 and 90.2 are shown along with flaps 90.3 and 90.4.

Figure 16A:
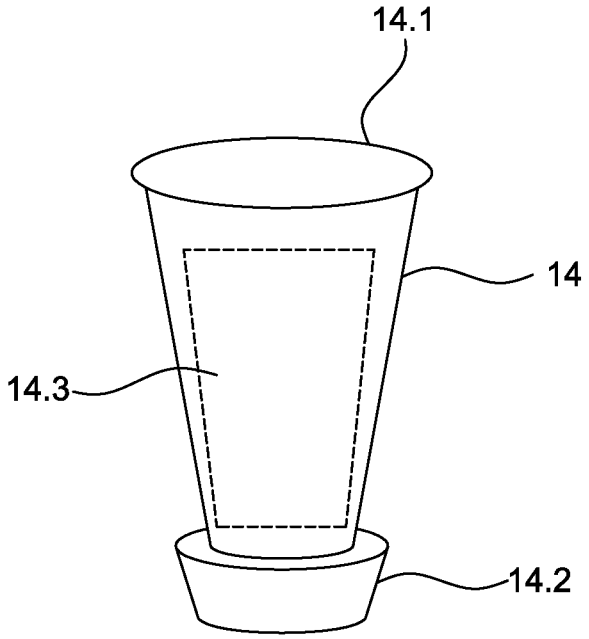
FIG. 16A is a side view of the shield.

FIG. 16A is a side view of the shield 14, which includes a top or a top cap 14.1 and an inner packed section 14.3 and a bottom or bottom cap 14.2 which fits around the bottom of the body of shield 14. Bottom 14.2 cap can be configured to be removed so that a bottom of the body of shield 14 can fit inside of body 300 so that the shield 14 can be positioned to extend outside of the body 300.

Figure 16B:
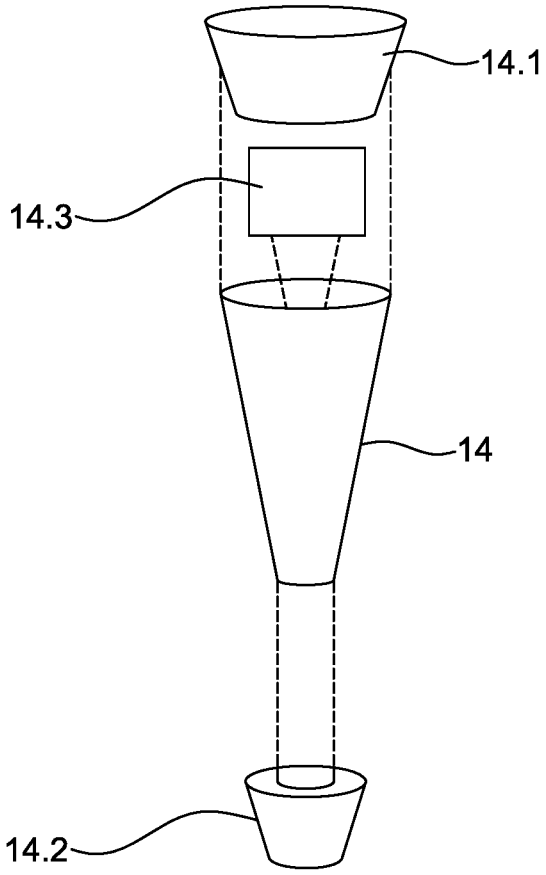
FIG. 16B is an exploded view of the shield of the embodiment of FIG. 16A.

FIG. 16B is an exploded view of the shield of the embodiment of FIG. 16A wherein there is shown body of a shield 14 with packed section 14.3 made from flammable or smokable material. There is a bottom section or cap 14.2 which can be removed but is also configured to fit inside of body 300.

Figure 16C:
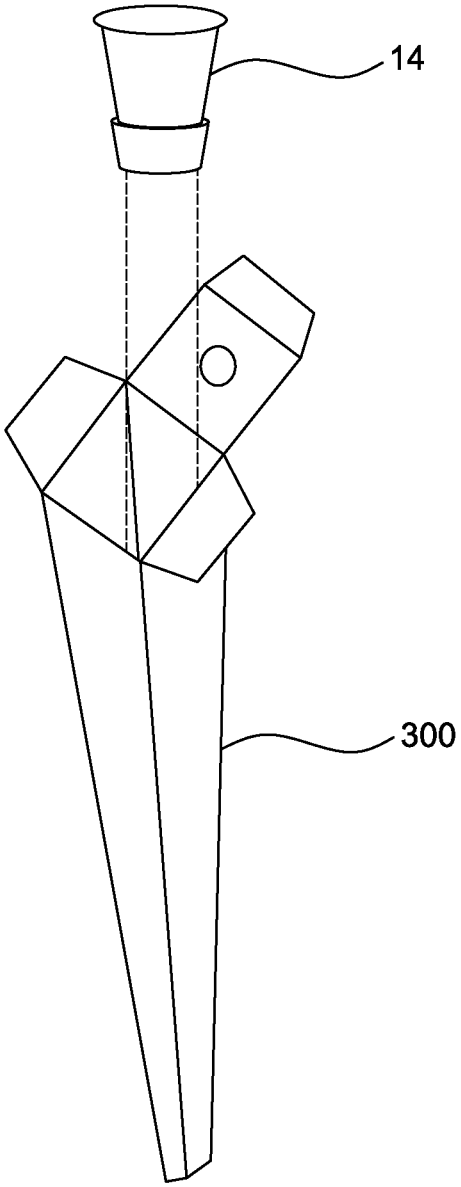
FIG. 16C is a side view of another embodiment showing the shield fitting inside of a body of a pipe.

FIG. 16C shows a side view of a shield 14 which can be disposed inside of a body 300 of a pipe. The shield may be made from any suitable material but in at least one embodiment, this shield is made from a metal material. The shield may be pre-packaged with smokable material as a pre-sealed container.

Figure 16D:
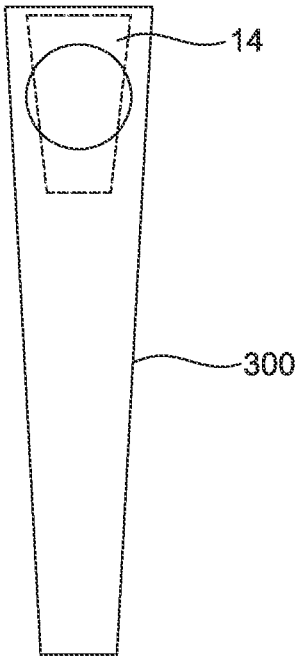
FIG. 16D is a side view of the shield disposed inside of the pipe.

FIG. 16D shows a side view of the shield 14 disposed inside of the housing body 300 of the pipe. Thus, a single use package with the housing containing the shield may be shipped to or sold to consumers with the shield having a pre-packaged amount of smokable material disposed therein.

Figure 16E:
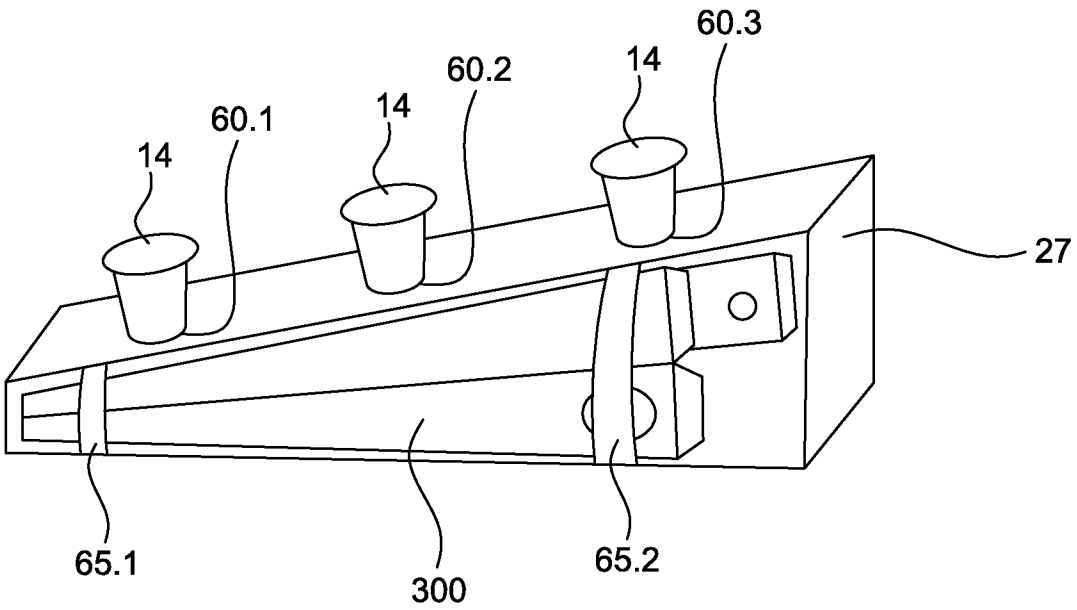
FIG. 16E is a side view of another embodiment of the invention.

FIG. 16E is a side view of another embodiment of the invention. In this view there are a plurality of shields 14 fitting into associated holes 60.1, 60.2, 60.3 in body or box 27. There are also a plurality of straps 65.1 and 65.2 configured to receive additional bodies 300 positioned along a side of body or box 27.

Figure 16F:
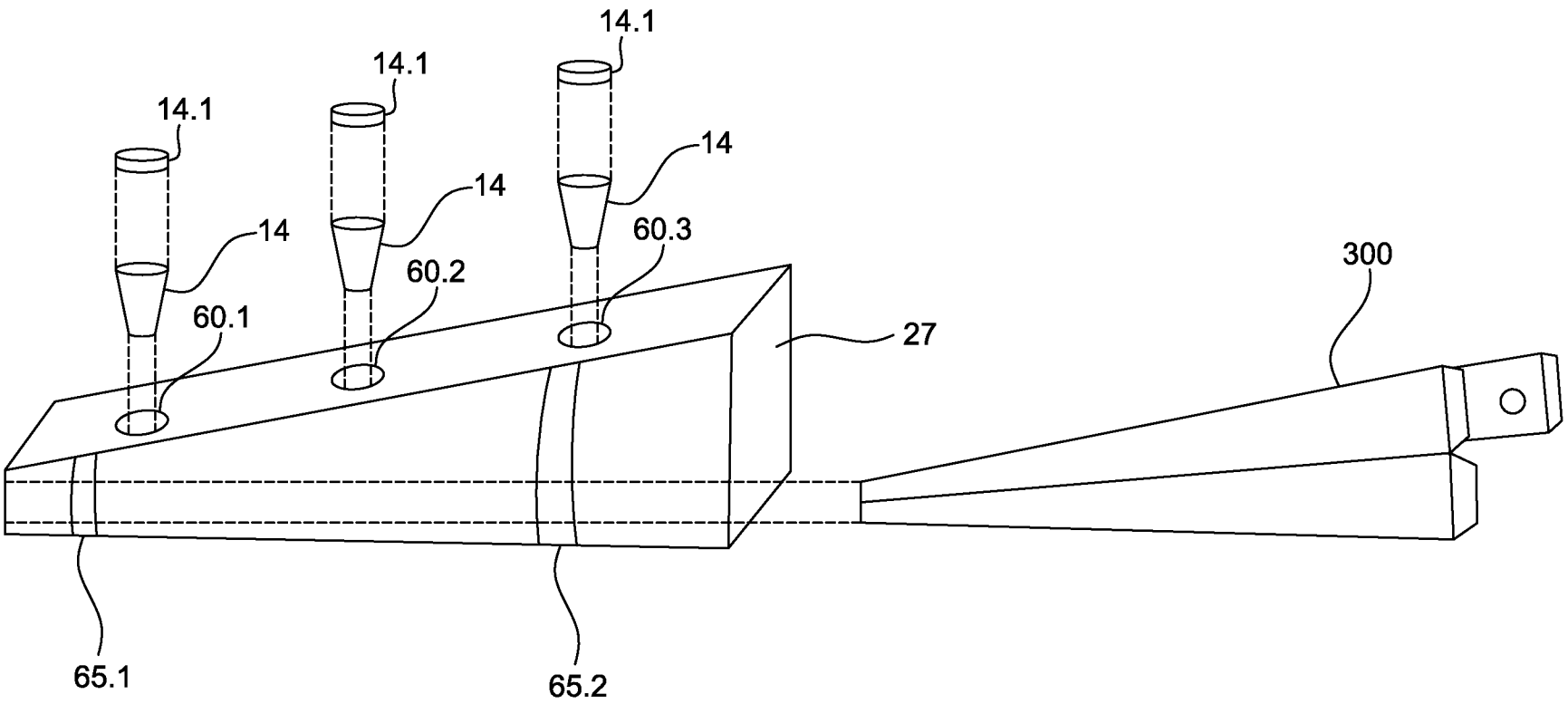
FIG. 16F is a side exploded view of the embodiment of FIG. 16E.

FIG. 16F is a side exploded view of the embodiment of FIG. 16E which includes a box 27 having straps 65.1 and 65.2 with an insert body 300 being removed from the straps 65.1 and 65.2. The box 27 is presented as an array of different shields 14 which also contain a plurality of different pipe bodies 300 as well.

The shields 14 each comprise a shield top 14.1 which is slidable inside of each of the respective shields 14. Body 300 is slidable inside of box 27. In this way the body 300 forms a disposable body. Which can be disposed inside of box 27.

Figure 17A:
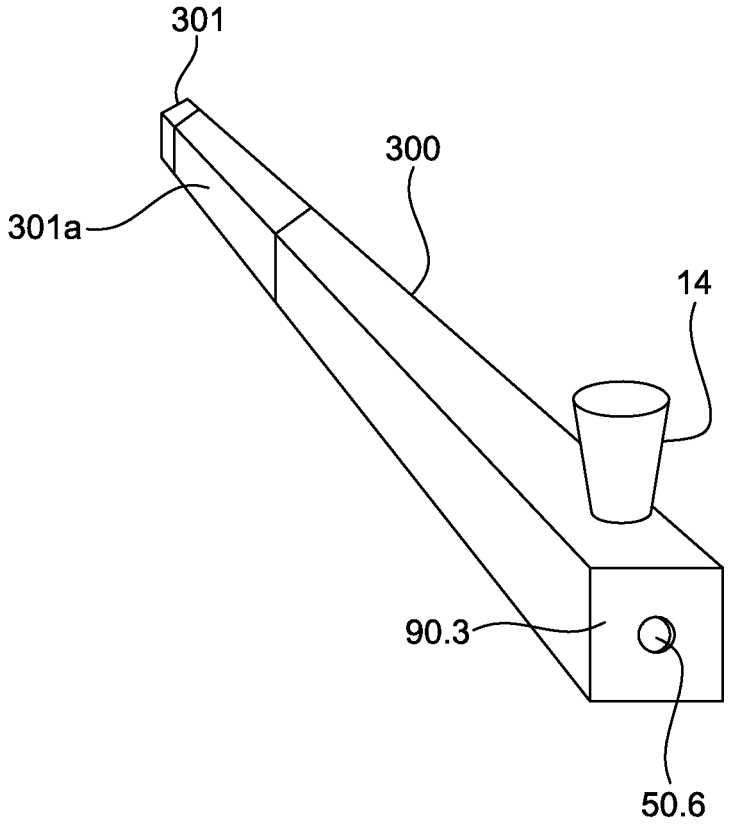
FIG. 17A is a side perspective view of another embodiment of the invention.
Figure 17B:
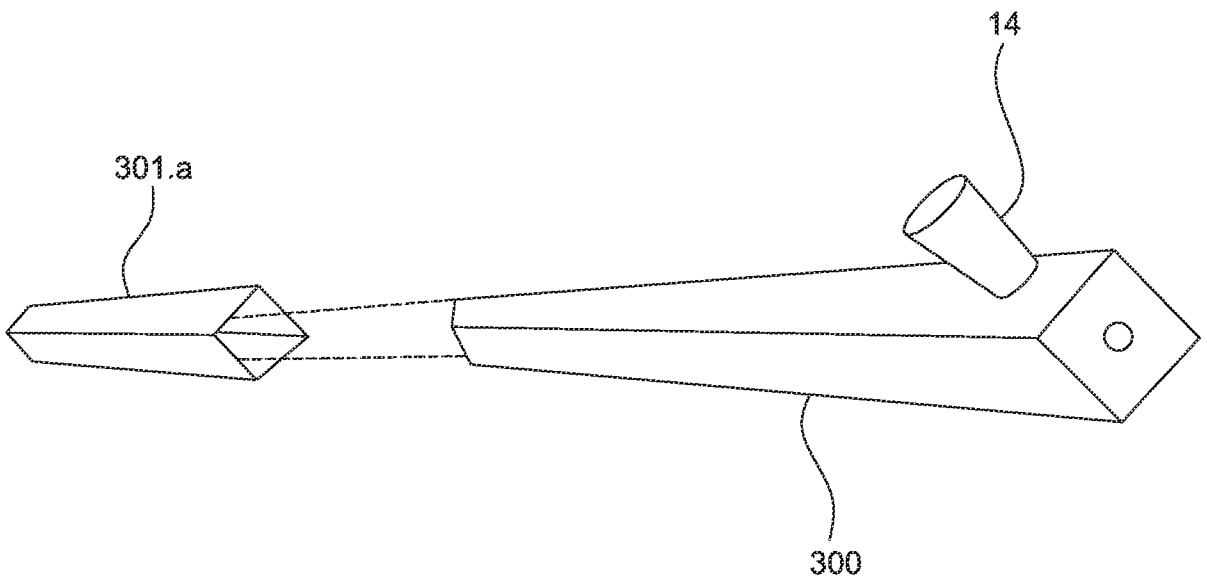
FIG. 17B is an exploded view of the embodiment of FIG. 17A.

FIG. 17A is a side perspective view of another embodiment of the invention which comprises body 300 comprising end cap 301*a*. End cap 301*a* is slidable on end 301. A shield 14 is also positioned in this body as well. Opening 50.6 is also shown on end flap 90.3. In this way, end cap 301*a* can be selectively removed when it is convenient. FIG. 17B is an exploded view of the embodiment of FIG. 17A showing the end cap 301*a* removed from the body 300. With this design, the end cap 301*a* can be a separate part that can be replaced while still making body 300 reusable. This end cap 301*a* can be flavored or accented to fit the user's taste. End cap 301*a* can be friction fit onto the end of body 300.

Figure 19:
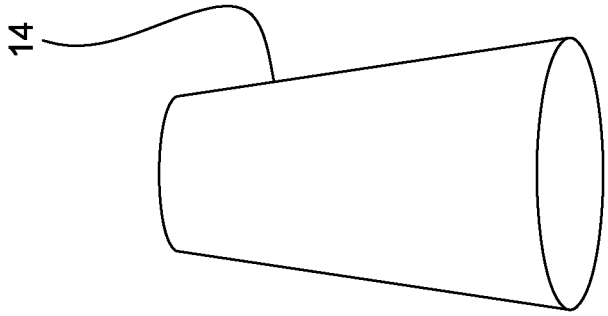
FIG. 19 is another side view of a shield for a water pipe or a pipe.
Figure 18:
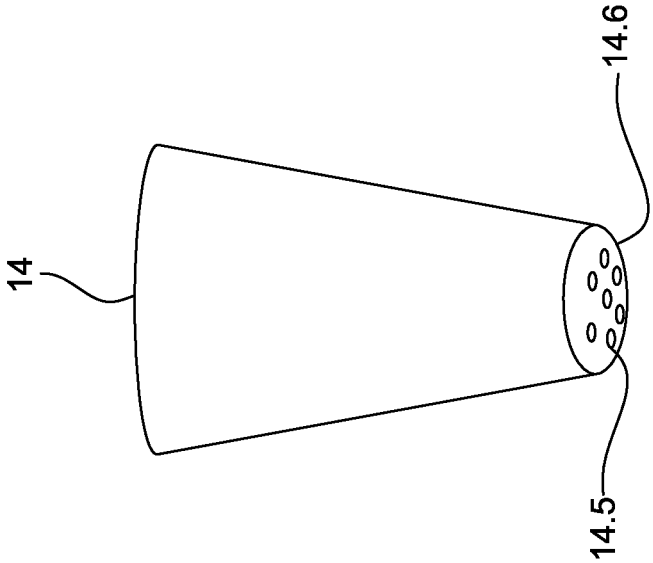
FIG. 18 is a side view of a shield for a water pipe.

FIG. 18 is a side view of a shield 14 for a water pipe or pipe which includes a plurality of holes 14.5 in a bottom 14.6. FIG. 19 is another side view of a shield 14 for a pipe.

Figure 20A:
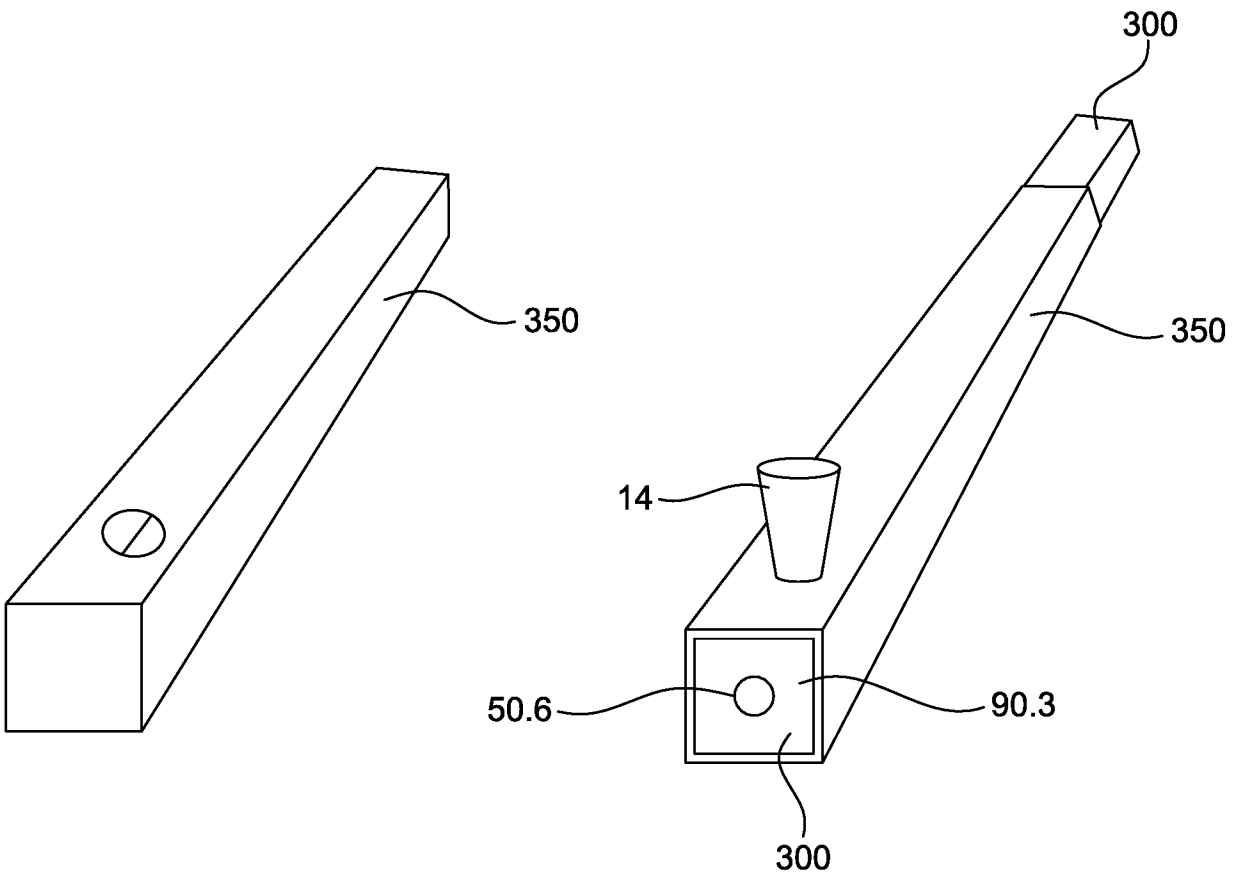
FIG. 20A is a view of another embodiment as a kit comprising multiple parts.

FIG. 20A is a view of another embodiment as a kit comprising multiple parts which includes a cover body 350 having a hole 351 positioned in the body. The hole is for receiving shield 14. In addition, adjacent cover 350 is another cover 350 having body 300 positioned therein with shield 14 extending through body 350 and body 300 to lock both bodies together. End hole 50.6 is also shown with flap 90.3 being shown as well.

Figure 20B:
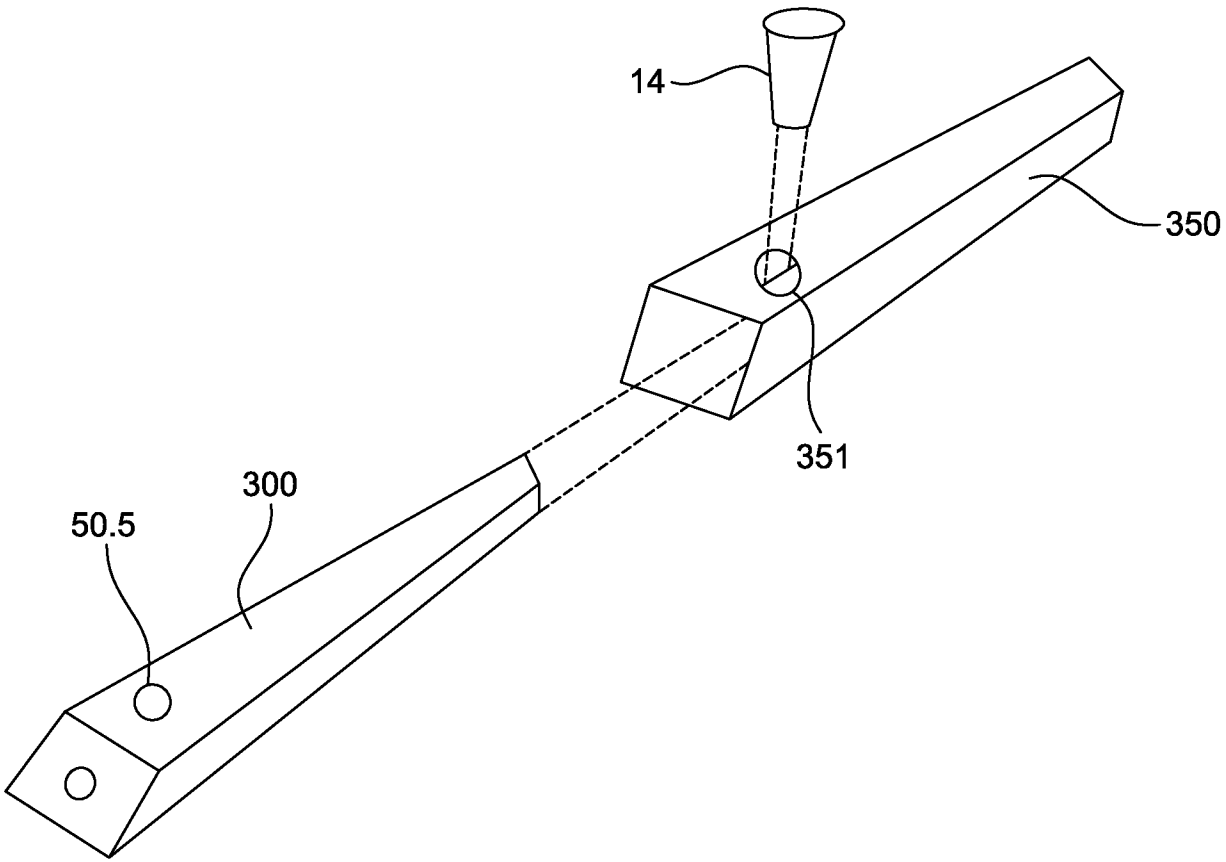
FIG. 20B is an exploded view of the embodiment of the kit comprising multiple parts.

FIG. 20B is an exploded view of the embodiment of the kit comprising multiple parts with body 300 being fit inside of cover 350 in a friction fit manner with the sides of body 300 pressing against the insides of cover 350 to form a friction fit connection. In addition, shield 14 is inserted through associated holes 50.5 and 351 to lock to the body 300 to cover 350.

Figure 21:
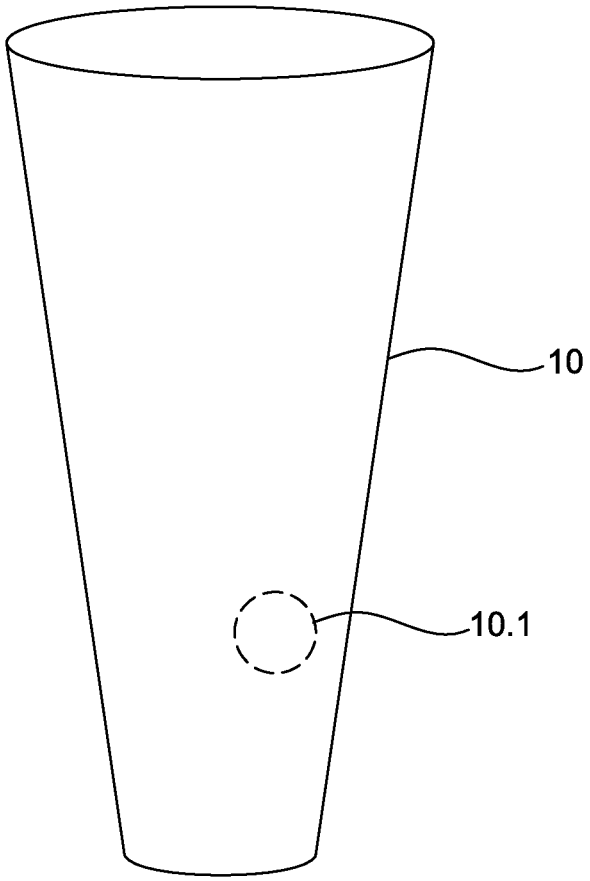
FIG. 21 is a side view of a water container with perforated hole.

FIG. 21 is a side view of a water container 10 which is configured to house a perforated hole 10.1 for receiving a stem, which ultimately receives a shield such as shield 14.

While many different materials can be used, the structure of the base elements can be made from paper or a modified paper product while the shield can be made from a more substantial fire-proof material such as metal. However, in at least one embodiment the base components or elements such as the water container, the base, or the shield can be made from plastic or from any other suitable material.

While at least one embodiment of the present invention have been shown and described, it is to be understood that many changes and modifications may be made thereunto without departing from the spirit and scope of the invention as defined in the appended claims.

What is claimed is:

1. A portable compact water pipe comprising:

a) at least one base section having at least one hole;

b) at least one water container section having at least one hole;

c) at least one stem said stem being frusto-conical in shape;

wherein when said at least one base section is coupled to said at least one water container section, at least at one orientation, said hole on said at least one base section and said hole on said at least one water container section are configured to be lined up, and wherein when said at least one stem is inserted into said at least one hole on said at least one base section, and said at least one hole on said water container section, said at least one stem locks said at least one water container section to said at least one base section via friction fit wherein said hole on said water container section and said hole on said base section are sized for a friction fit with said stem.

2. The portable compact water pipe, as in claim 1, wherein at least a portion of said at least one base section comprises paper.

3. The portable compact water pipe, as in claim 1, wherein at least a portion of said at least one water container section comprises paper.

4. The portable compact water pipe, as in claim 1, wherein at least a portion of said at least one stem comprises paper.

5. The portable compact water pipe as in claim 4, wherein at least a portion of said at least one stem comprises metal.

6. The portable compact water pipe as in claim 1, wherein said at least one base section is substantially conical shaped.

7. The portable compact water pipe as in claim 1, wherein said at least one water container section is substantially conical shaped.

8. The portable compact water pipe as in claim 1, wherein said water container section comprises at least one additional hole.

9. The portable compact water pipe as in claim 1, wherein said at least one stem comprises at least a paper section and at least a metal section.

10. The portable compact water pipe as in claim 1, wherein said at least one base section has at least one seam configured to allow the base section to be folded.

11. The portable compact water pipe as in claim 1, wherein said at least one water section has at least one seam configured to allow said at least one water section to be folded.

* * * * *